US010625841B2

(12) United States Patent
Todter

(10) Patent No.: US 10,625,841 B2
(45) Date of Patent: Apr. 21, 2020

(54) PASSIVE, AUTOMATIC WING CONTROL MECHANISM FOR VESSEL

(71) Applicant: SubSeaSail LLC, San Diego, CA (US)

(72) Inventor: Chris Todter, San Diego, CA (US)

(73) Assignee: SubSeaSail LLC, San Diego, CA (US)

( * ) Notice: Subject to any disclaimer, the term of this patent is extended or adjusted under 35 U.S.C. 154(b) by 0 days.

(21) Appl. No.: 16/186,435

(22) Filed: Nov. 9, 2018

(65) Prior Publication Data

US 2019/0135401 A1 May 9, 2019

Related U.S. Application Data

(60) Provisional application No. 62/584,063, filed on Nov. 9, 2017.

(51) Int. Cl.

| | |
|---|---|
| ***B63H 25/04*** | (2006.01) |
| ***B63B 15/00*** | (2006.01) |
| ***B63H 9/06*** | (2020.01) |
| ***B63B 35/00*** | (2020.01) |

(52) U.S. Cl.

CPC ..... *B63H 25/04* (2013.01); *B63B 15/0083* (2013.01); *B63B 35/00* (2013.01); *B63H 9/06* (2013.01); *B63B 2035/007* (2013.01)

(58) Field of Classification Search

CPC ... B63H 9/00; B63H 9/04; B63H 9/06; B63H 9/08; B63H 25/00; B63H 25/04; B63B 15/00; B63B 15/0083; B63B 35/00

USPC ..... 114/102.1, 102.25, 102.27, 102.12

See application file for complete search history.

(56) References Cited

U.S. PATENT DOCUMENTS

| | | | | |
|---|---|---|---|---|
| 4,625,671 A * | 12/1986 | Nishimura | ..... | B63H 9/0642 114/102.25 |
| 4,733,624 A * | 3/1988 | Belvedere | ..... | B63H 9/0642 114/102.25 |
| 7,798,084 B2 * | 9/2010 | Stroj | ..... | B63H 9/0642 114/102.1 |

* cited by examiner

*Primary Examiner* — Lars A Olson

(74) *Attorney, Agent, or Firm* — Thibault Patent Group

(57) ABSTRACT

Embodiments of the present invention are directed to a passive, automatic wing-control mechanism for sailing vessels. A cam is attached to one end of a rotatable mast as part of a rotatable wing, and a tensioner is configured to exert a constant force perpendicularly against the cam. When a wing is in a no-go sailing angle with respect to an apparent wind, the cam does not exert a torque on the mast. When the wing is outside the no-go sailing angle, the cam exerts a counter-torque to a torque caused by the apparent wind acting on the rotatable wing, causing the wing to remain at a predetermined angle with respect to the apparent wind.

17 Claims, 15 Drawing Sheets

PASSIVE, AUTOMATIC WING CONTROL MECHANISM FOR VESSEL

CROSS-REFERENCE TO RELATED APPLICATIONS

The present application claims the benefit of U.S. Provisional Application No. 62/584,063, filed on Nov. 9, 2017, the entirety of which is incorporated by reference herein.

BACKGROUND

Field of Use

The present application relates generally to sailing vessels in general and more specifically to a technique to automatically position a wing of a sailing vessel for optimal vessel performance.

Description of the Related Art

In order for any sailboat or other sail-powered vessel to effectively capture and utilize the wind, the orientation of one or more sails, or "wings", must be positioned at an optimal angle with respect to the apparent wind. Traditionally, this is done manually by crew members pulling on ropes or operating winches, motors or hydraulic actuators. In autonomous sailing vessels, motors or electric actuators may be used to control the angle of a sail via onboard control systems, or these motors or actuators may be remote-controlled by sending sail positioning commands to the vehicle.

Using such traditional measures to control the angle of a sail is manually intensive in the case where crew members control the sail. In addition, the motors and actuators are typically very expensive, as they are generally designed to provide large torques and survive in harsh marine environments. In autonomous vehicles, where no crew is onboard, complex electronics and algorithms must be added to autonomously control the orientation of the sail and, in semi-autonomous operation, a receiver for receiving remote control commands may be needed in order for a remote operator to orient the sail.

It would be desirable, therefore, to be able to automatically control the orientation of a sail without human intervention or complicated, expensive hardware.

SUMMARY

Embodiments of the present application are directed towards a mechanism to automatically control an orientation of a wing on a sailing vessel, comprising, a cam comprising a dwell portion and a nose portion that form a cam profile, and a retainer formed longitudinally therethrough for securing a mast of the wing therein, a tensioner comprising a first portion in contact with the cam profile and exerting a predetermined force perpendicularly against the cam profile, wherein the dwell portion comprises a constant first radius from a center point of the retainer between a first cam angle and a second cam angle, and the nose portion comprises a symmetric nose profile that causes the cam to produce a counter-torque against the mast when the tensioner is in contact with the nose profile.

In another embodiment, a sailing vessel is described, having a capability of automatically controlling its wing, comprising a deck a mast mount formed into the deck, a cam comprising a mast hole co-located with the mast mount, the mast, having a first end portion rotatably secured within the mast mount and fixedly secured to the cam via the mast hole, a tensioner comprising a first portion in contact with a cam profile of the cam and exerting a predetermined force perpendicularly against the cam profile, wherein the cam profile comprises a dwell portion and a nose portion, the nose portion configured to generate a counter-torque to counteract a mast torque produced by the mast.

In yet another embodiment, a mechanism is described to automatically control an orientation of a rotatable mast of a sailing vessel, the mast producing a mast torque as an apparent wind acts on a sail coupled to the mast, the mechanism comprising, means for producing a counter-torque against the mast torque when the mast is rotated by the wind to a first orientation, comprising a retainer formed longitudinally therethrough for securing an end portion of the mast therein, and means for exerting a predetermined force perpendicularly against the means for producing the counter-torque, wherein the counter-torque is equal in magnitude to the mast torque, causing the mast orientation to remain at a predetermined orientation with respect to the apparent wind.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

It should he understood that the components shown in the figures may not be scaled to size to each other.

DETAILED DESCRIPTION

Embodiments of the present invention describe an automatic, passive, wing-control mechanism used on sailing vessels. In one embodiment, a cam and a tensioner are described that are used to keep a rotatable wing of a sailing vessel at a predetermined orientation with respect to an apparent wind. In another embodiment, a vertical cam and a roller are used to keep a rotatable wing of a sailing vessel at a predetermined orientation with respect to an apparent wind. These embodiments offer advantages over prior art wing positioning systems, as they are capable of automatically setting a wing at nearly optimally orientations without the use of human crews, electronic controllers, actuators, or power. Also described herein is an underwater docking station utilizing a submerged sailing vessel, for providing recharging and/or communications to autonomous underwater vehicles (AUVs).

Figure 1:
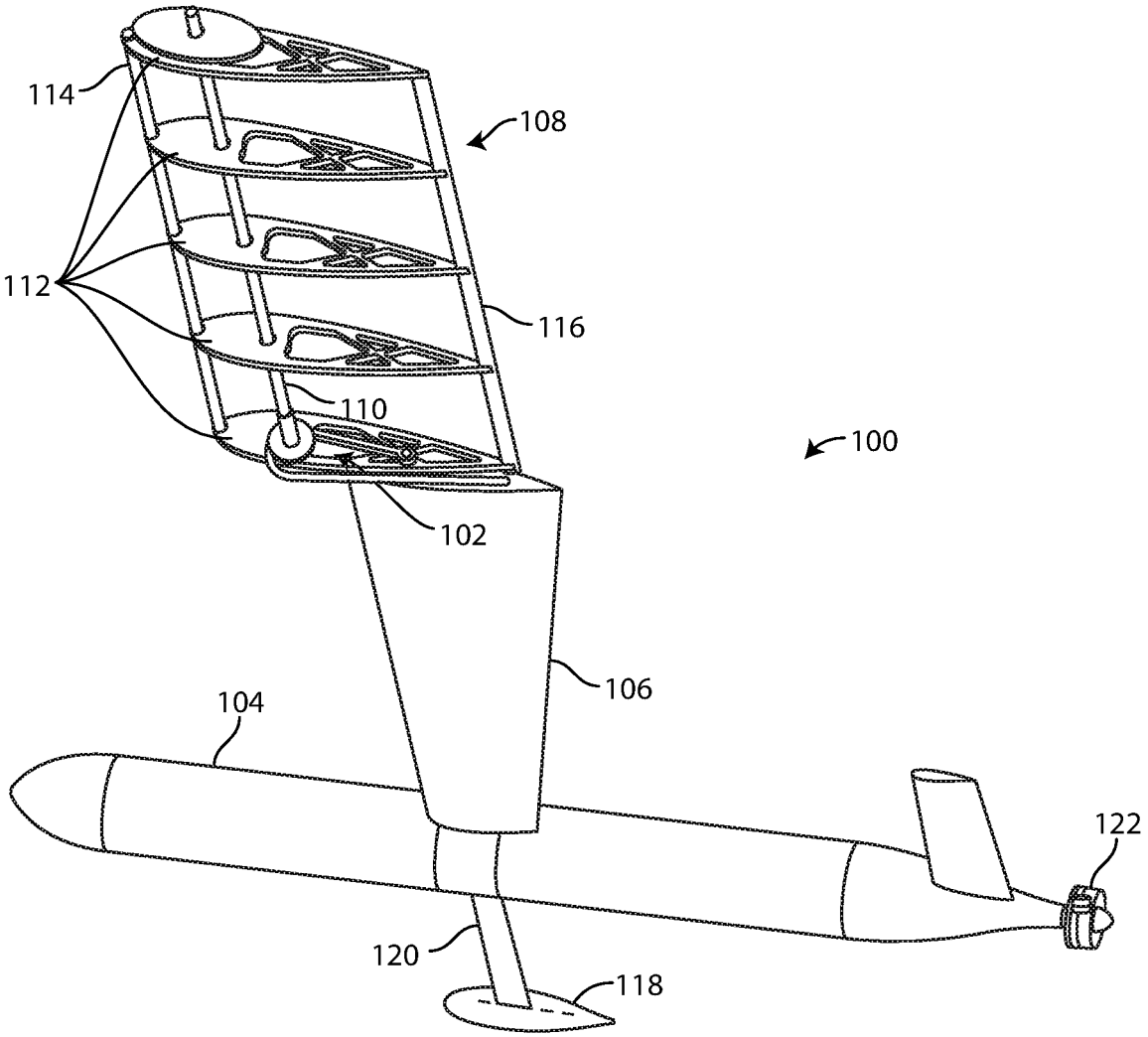
FIG. 1 is a perspective view of one embodiment of a submerged sailing vessel, utilizing an automatic, passive, wing-control mechanism.

FIG. 1 is a perspective view of one embodiment of a submerged sailing vessel 100, utilizing an automatic, passive, wing-control mechanism 102, herein referred to as mechanism 102. Submerged sailing vessel 100 is a semi-submerged vessel that utilizes wind energy to propel an underwater hull 104 through the water. A detailed description of such a submerged sailing vessel is found in U.S. Pat. No. 10,029,773 entitled, "Submerged Sailing Vessel", assigned to the assignee of the present application and incorporated by reference in its entirety herein. A keel 106 extends upward from hull 104 and is attached to wing 108, which is rotatable about mast 110. Wing 108 is shown without a sail, in order to illustrate a series of oblong, ribs 112, parallel and spaced apart from each other and coupled to one another via a leading strut 114 and a trailing strut 116. A hole through each rib 112 allows mast 110 to extend through all of the ribs, so that the ribs, and thus wing 108 are rotatable around mast 110. The perimeter of ribs 112 define a wing shape that is aerodynamically efficient to provide propulsion to hull 104. In one embodiment, the ribs 112 may comprise photovoltaic panels or cells to generate energy for use aboard hull 104. A detailed description of a submerged sailing vessel utilizing such ribs is described in U.S. patent application Ser. No. 16/117,452, entitled "Solar Wing System and Apparatus", assigned to the assignee of the present application and incorporated by reference in its entirety herein.

Submerged sailing vessel 100 may additionally comprise ballast 118 coupled to hull 104 via strut 120 for providing lateral stability to submerged sailing vessel 100, to combat rotational forces caused by the wind as it acts on wing 108. Submerged sailing vessel 100 may additional comprise thruster 122 to propel submerged sailing vessel 100 in addition to the propulsion provided by wing 108.

Figure 2:
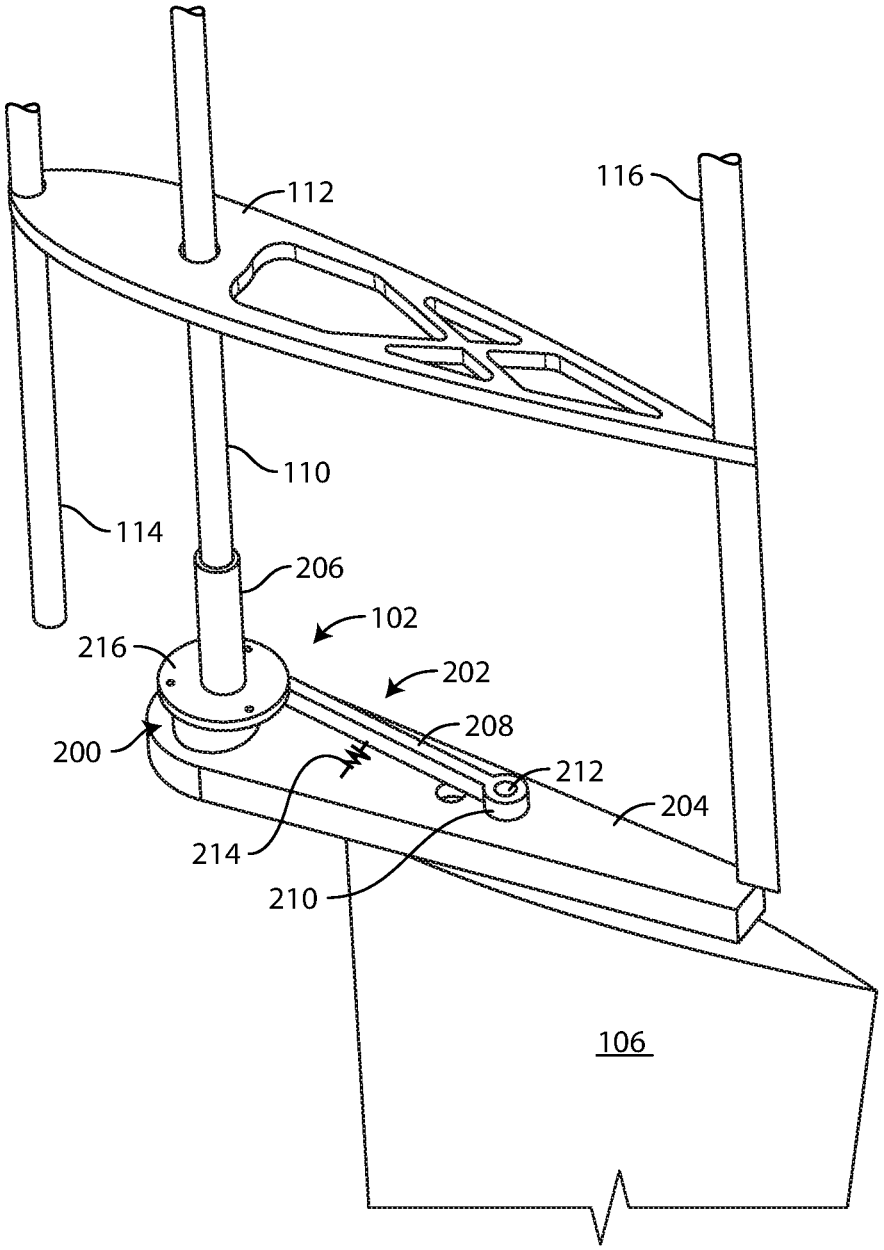
FIG. 2 is a close-up, perspective view of a wing as part of the submerged sailing vessel as shown in FIG. 1.

Mast 110 is fixedly mounted to mechanism 102, more particularly shown in FIG. 2. FIG. 2 is a close-up, perspective view of the wing 108 and keel 106 detailing mechanism 102. The lowest-most rib 112, shown in FIG. 1, is not shown in FIG. 2, in order to better view the components of mechanism 102.

Mechanism 102 comprises a cam 200 and a tensioner 202. Each of these components are located on a surface of deck 204 in this embodiment. However, in other embodiments. mechanism 102 could be located underneath deck 204. While deck 204 is shown in FIG. 2 as a small, rigid platform to support wing 108, in other embodiments, it could comprise a deck of a typical sailboat, catamaran, a paddle board, or some other sailing vessel, In one embodiment, cam 200 comprises a sleeve 206 extending perpendicularly from flange 216 that acts as a retainer for mast 108. Flange 216 offers support for a lower-most rib 112 (not shown). In other embodiments, flange 216 is not used, for example, in an embodiment where mechanism 102 is used with a wing comprising a standard mast and sail. In some embodiments, deck 204 comprises a mast mount underneath cam 200, where mast 110 may extend to an underside of deck 204. The mast mount may comprise, simply, a through or partial hole formed into deck 204, or it could comprise a mechanism, such as one or more roller bearings formed into a partial or through hole, a sleeve, etc. Mast 110 is generally free to rotate within the mast hole, but in a fixed relationship to cam 200.

Cam 200 is rotatable with respect to deck 204, but fixedly attached to mast 110, such that when mast 110 rotates, cam 200 rotates as well. Tensioner 202 is used to apply a predetermined force against a surface of cam 200, which helps to generate a counter-torque by mechanism 102 that acts on mast 110 as mast 100 is rotated by the wind acting on wing 108. When wing 108 is in between approximately +/−20 degrees of the apparent wind, no counter-torque is generated by cam 200, and wing 108 is free to move into a position of either +20 degrees or −20 degrees with respect to the apparent wind. Cain 200 is shaped such that as the wind blows wing 108 past either the +20 or −20 degree mark, cam 200 is rotated along with mast 110, causing cam 200 to generate a counter-torque against a torque on mast 110 from the wind acting on wing 108, by the interaction of the force of tensioner 202 against cam 200 at any particular rotational angle of cam 200. The counter-torque is generally constant as cam 200 is rotated further in one direction or the other. The result is that wing 108 remains in an optimal orientation with respect to the apparent wind to propel vessel 100 at a maximum speed.

Tensioner 202, in the embodiment shown in FIG. 2, comprises a longitudinal tension bar 208 comprising a collar 210 at one end that is rotatably coupled to post 212 extending from deck 204. An opposing end of tension bar 208 (not shown in FIG. 2) is forced against cam 200 with a predetermined force created by mechanical energy storage means 214, such as one or more coil springs, elastic bands, gas struts, or some other mechanical device that applies a tension to tension bar 208, or otherwise provides a spring force against tension bar 208 in a direction that forces the opposing end of tension bar 208 against cam 200. In another embodiment, mechanical energy storage means 214 could comprise a torsion spring applied to the inside of collar 210. In other embodiments, tensioner 202 could comprise a spring-loaded plunger mounted perpendicularly to cam 200 such that the plunger is forced towards cam 200 linearly at a force determined by a spring force of the spring, In one embodiment, tension bar 208 is approximately 188 millimeters long, while a maximum diameter of cam 200 is approximately 83 millimeters, in an embodiment where vessel 100 is relatively small, such as less than 10 feet in length.

Figure 3:
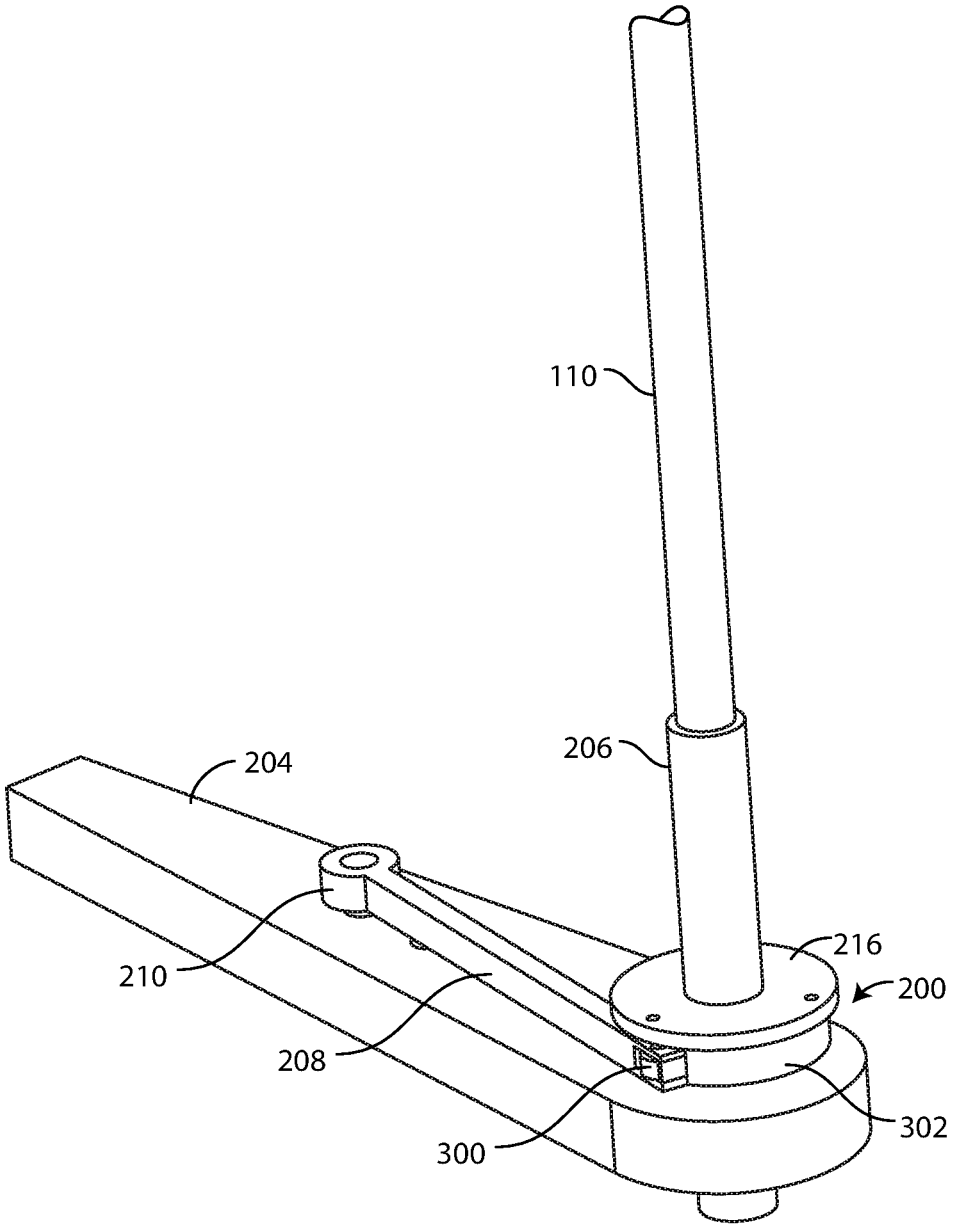
FIG. 3 is a perspective view of the automatic, passive, wing-control mechanism as shown in FIGS. 1 and 2, viewed at an opposing angle from the view as shown in FIG. 2.

FIG. 3 is a perspective view of mechanism 102 located on deck 204, viewed at an opposing angle from the view shown in FIG. 2. In this view, opposing end 300 is of tension bar 208 is forced against a cam wall 302 of cam 200, the perimeter of cam wall 302 referred to herein as a cam profile. In one embodiment, opposing end 300 comprises a roller bearing, or some other friction-reducing mechanism, such as a ball bearing or a low-friction material such as polytetetrafluoroethylene, commonly known as Teflon®. Mast 110 is retained by sleeve 206 and in a fixed physical relationship with cam 200, i.e., cam 200 is rotated by mast 110 as mast 100 is rotated by the wind acting on wing 108. In this embodiment, mast 110 is shown extending through cam 200 and deck 204, protruding from an underside of deck 204.

Figure 4:
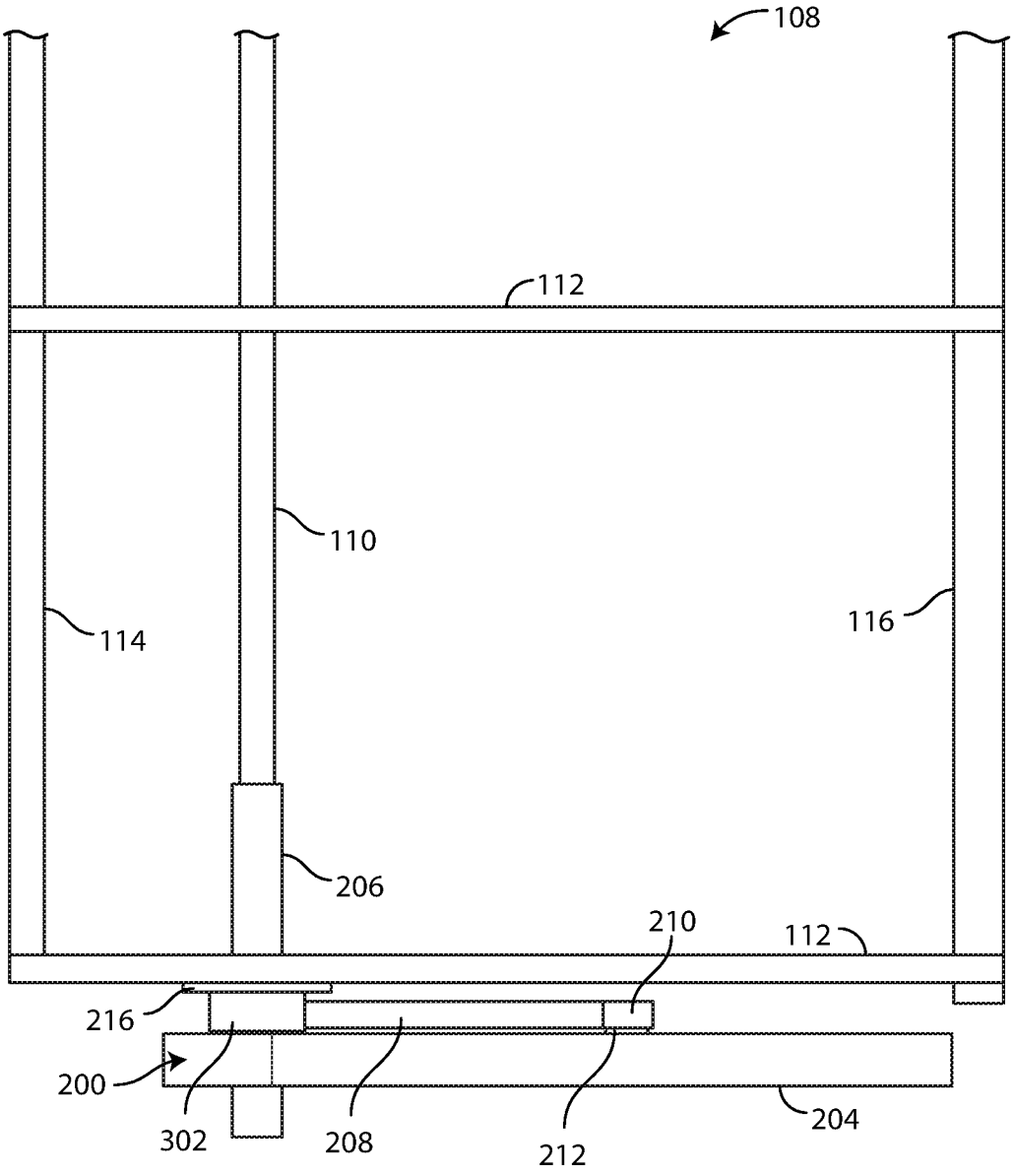
FIG. 4 is a side view of the automatic, passive, wing-control mechanism as shown in FIGS. 1-3 in use with the wing as shown in FIG. 1.

FIG. 4 is a side view of mechanism 102 in use with wing 108, where wing 108 comprises the structure shown in FIG. 1. It should be understood that the wing could, alternatively, comprise a standard, prior-art mast having a boom and one or more sails attached. Flange 216 may be fixedly attached to an underside of rib 112 so that cam 200 is rotated not only by the fixed relationship between sleeve 206 and mast 110, but also by rib 112 as part of wing 108. It should be understood that in some embodiments, sleeve 206 is not used, and mast 110 extends through a retainer formed longitudinally through cam 200 and secured therein by one or more standard retainers, such as bolts, rivets or screws. In one embodiment, the retainer comprises, simply, a through hole, while in other embodiments, the retainer comprises a sleeve.

Figure 5:
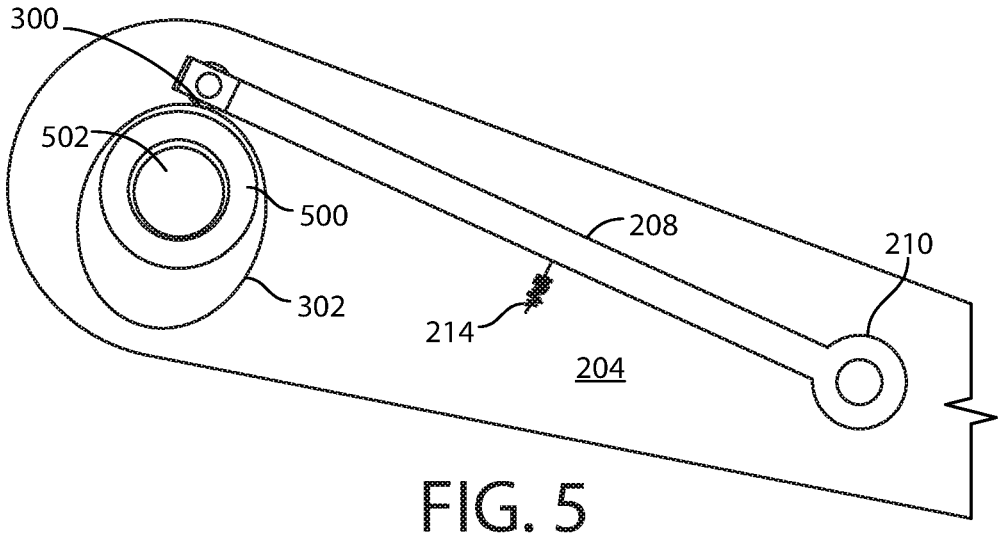
FIG. 5 is a top view of the automatic, passive, wing-control mechanism as shown in FIGS. 1-4 located on a deck, with a flange hidden from view in order to better illustrate the relationship between a cam and an opposing end of a tension bar.

FIG. 5 is a top view of mechanism 102 located on deck 204, with flange 216 hidden from view in order to better illustrate the relationship between cam 200 and, more specifically, cam wall 302 and opposing end 300 of tension bar 208. As described earlier, opposing end 300 of tension bar 208, shown as comprising a roller bearing, is forced against cam wall 302 via mechanical energy storage means 214. The cam wall or profile 302 is configured to create a constant or near-constant counter-torque against mast 110 as mast 110 rotates cam 200 in relation to opposing end 300. Cam profile 302 comprises a nose portion and a dwell portion, described later herein. Cam 200 further comprises a mast retaining hole 500, shown as a hole formed longitudinally through cam 200, sized and shaped to receive mast 110 and configured to fixedly secure mast 110 therein. Ring bearing 502 may be included, defining a bottom surface of cam 200, which allows cam 200 to rest on top of deck 204 and rotate with very little friction.

Figure 6:
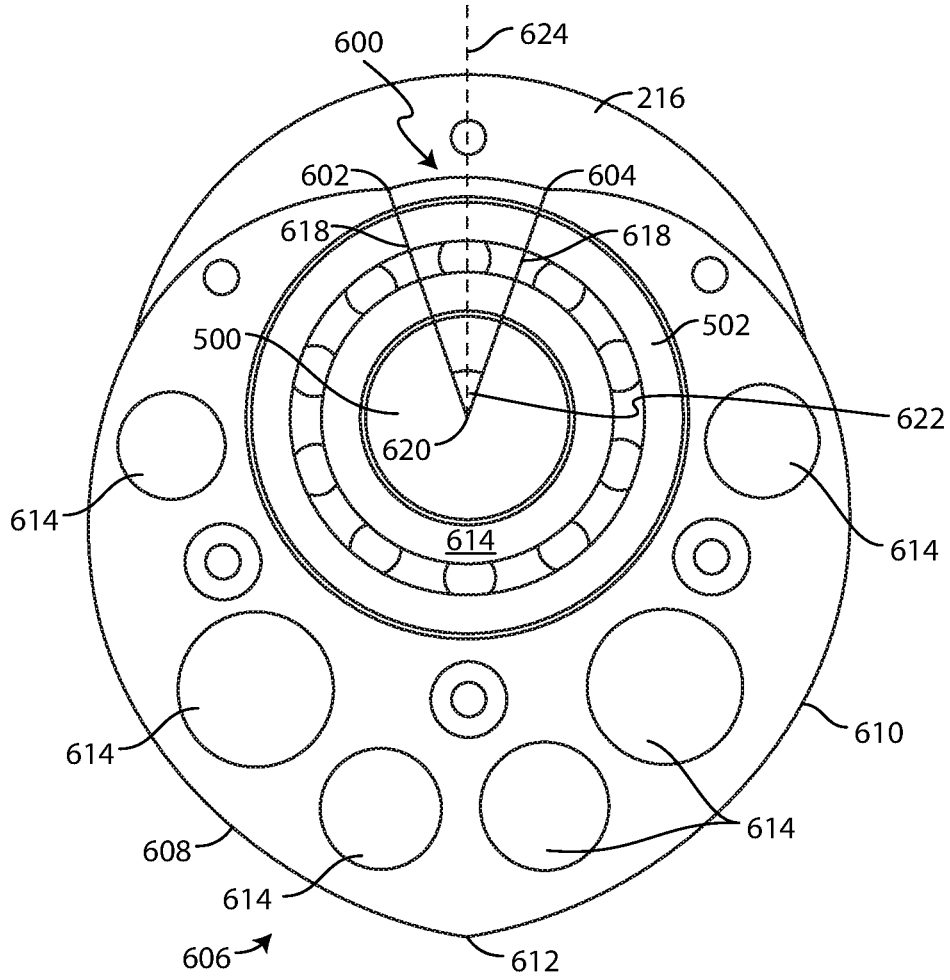
FIG. 6 is a bottom view of one embodiment of the cam as shown in FIG. 5.

FIG. 6 is a bottom view of one embodiment of cam 200. As before, in this embodiment, cam 200 comprises mast retaining hole 500, ring bearing 502, flange 216, and a cam profile 302 defined by a dwell portion 600, formed between point 602 to 604 along the cam profile, and a nose portion 606 extending from point 602 counter-clockwise around the cam profile to point 606. Nose portion 606 may be referred to as comprising two, symmetrical half profiles, i.e., a left nose profile 608 extending from point 602 to nose tip 612, and a right nose profile 610 extending from point 604 to nose tip 612. Dwell portion 600 may be defined by a dwell angle 622 formed from center point 620 to each of points 602 and 604, representing a "no-go" point of sale, as will be explained later herein. A plurality of holes 614 may be formed through cam 200 in order to make cam 200 lighter and to reduce material cost.

Dwell portion 600 is defined as having a constant radius 618 from a center point 620 of mast retaining hole 502. As such, cam 200 does not generate a counter-torque against mast 110 when opposing end 300 of tension bar 208 is in contact with cam wall 302 as cam 200 is rotated against opposing end 300 along dwell portion 600. Tension bar 208 is in contact with dwell portion 600 when wing 108 of vessel 100 is oriented at an angle in a "no-go" point of sail, i.e., a range of directions or angles into which a sailing vessel cannot sail. Sailing vessels cannot sail directly into the wind, nor on a course that is too close to an apparent wind, in the no-go zone, a vessel's wing ceases to produce enough drive to maintain forward momentum and, therefore, the vessel slows down towards a stop and steering becomes progressively less effective at controlling a direction of travel. The span of the no-go zone varies among sailing vessels, depending on the design of the vessel, its rig, and its sails, as well as on the wind strength and the sailing conditions (i.e., presence of currents, waves, etc.). The no-go zone may be from 18 to 50 degrees either side of the wind, or a 36 to 100 degree area centered on the apparent wind direction.

Nose portion 606 is defined as having a radius that varies from center point 620 to produce a counter-torque equal and opposite to a torque created by mast 110 as wind acts on wing 108. The magnitude of the counter-torque is dependent on the amount of force applied by tensioner 202 and the slope of the nose profile 608 at a contact point between the nose profile and opposing end 300. In one embodiment, two constants P2 and P3 are defined and used to determine a radius of nose profile 608 with respect to an angle from a centerline 624 of cam 200. In one embodiment, the radius at each angle between 0 and 180 degrees is determined, representing left nose profile 608 or right nose profile 610. The radius at each angle may be calculated as P3 multiplied by the particular angle under consideration, plus P2, plus the radius calculated at a previous angle, for any angle greater than an angle at which point 602 or 604 is located from centerline 624. For example, if P3 is chosen to be −0.000216440264194842 and P2 is chosen to be 0.192417834295711, and the radius of dwell portion 600 is chosen to be 15 millimeters, then the radius will be 15.56297 millimeters at an angle 23 degrees from centerline 624, on either the left nose profile 608 or the right nose profile 610. Once the radius has been defined for both nose profiles, a counter-torque value can he calculated at each angle using the spring constant of the selected mechanical energy storage means 214, an angle at which tension bar 208 rests against the nose profile, and a length of tension bar 208. P2 and P3 are chosen such that a counter-torque between successive angles is minimized.

Figure 7:
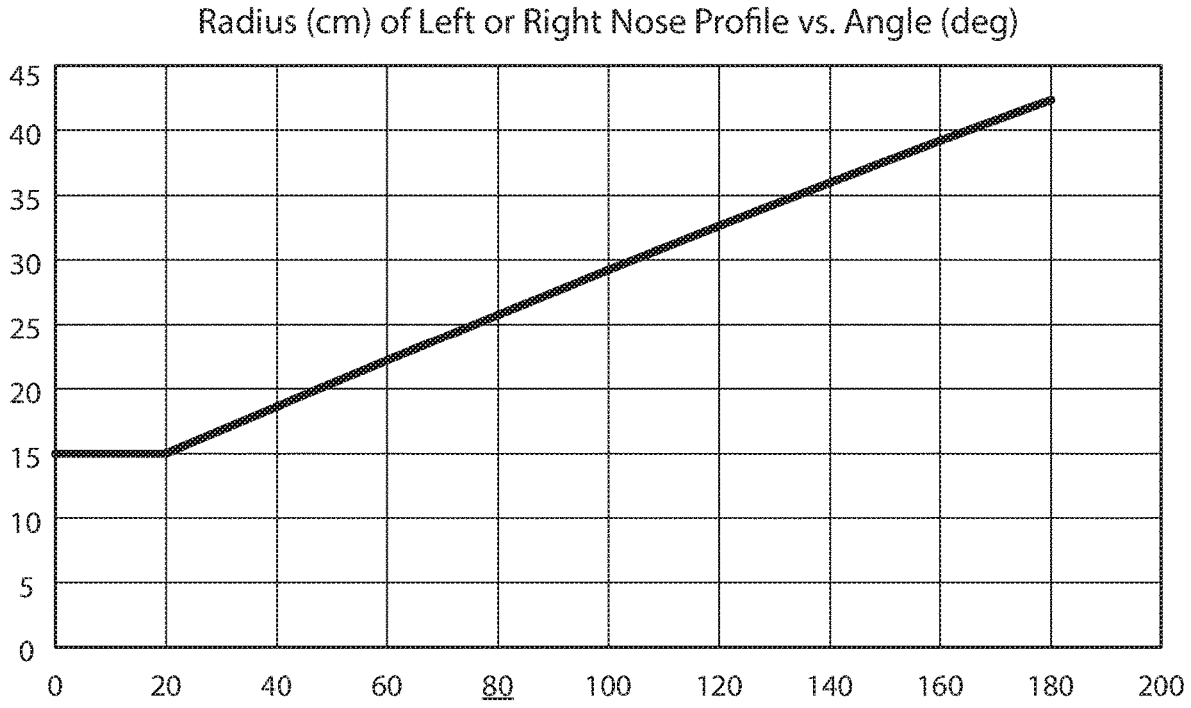
FIG. 7 is a graph, illustrating a radius of half of a dwell profile and a nose profile as a function of an angle from a centerline of the cam as shown in FIGS. 5 and 6.

FIG. 7 is a graph, illustrating the radius of half of dwell profile 600 and one of the nose profiles as a function of an angle from centerline 624. As expected, the radius between 0 and 20 degrees (representing point 602 or 604) is constant, at 15 millimeters. 20 degrees is selected to represent a minimum angle at which vessel 100 can sail into an apparent wind before entering a "no-go" point of sail. The radius then increases linearly, reaching a radius of approximately 42.3 millimeters at 180 degrees.

Figure 8:
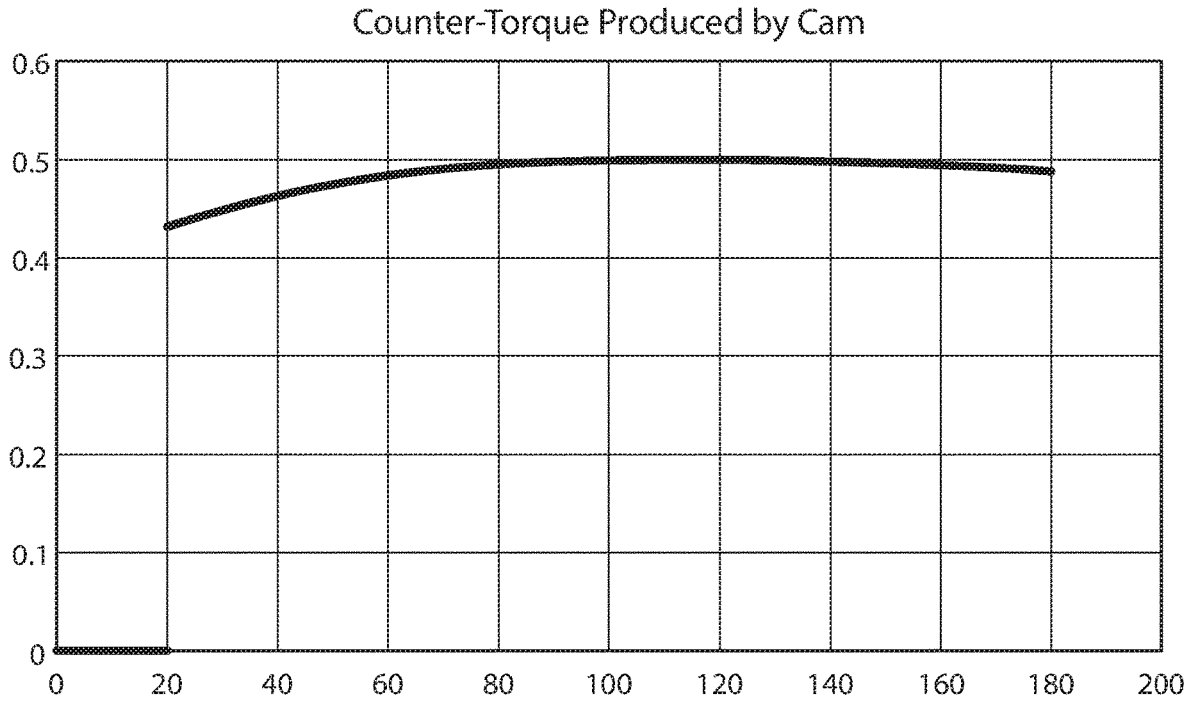
FIG. 8 is a graph, illustrating a counter-torque produced by the cam as shown in FIGS. 5 and 6.

FIG. 8 is a graph, illustrating a counter-torque produced by cam 200 against mast 110 as cam 200 is rotated by mast 110 in a single direction (i.e., clockwise) as the wind acts on wing 108. As shown, the counter-torque is zero when wing 108 is within the no-go point of sale, between 0 and 20 degrees, and then jumps to a value of about 0.43 Newton-meters at 21 degrees, increasing to about 0.5 Newton-meters at about 80 degrees, and remaining at about 0.5 Newton-meters for the remainder of the curve. The counter-torque is calculated using the force of opposing end 300 against cam 200 at each angle, and multiplying by the cam radius at each angle. A plurality of differential counter-torque values may be calculated by subtracting successive counter-torque values from each other, and then squaring each differential counter-torque value to determine an error curve that indicates how close the counter-torque curve is to being constant. P2 and P3 may be adjusted in order to arrive at an error curve that most closely resembles a constant counter-torque, A spreadsheet may be constructed in order to determine the nose and dwell profiles, to calculate various metrics such as a radius of the nose and dwell profiles at each angle of rotation of cam 200 in relation to centerline 624. A representative portion of such a spreadsheet is shown below:

The size and shape of the various components that make up mechanism 102, i.e., cam 200, tensioner bar 208, and mechanical energy storage means 214 all contribute to the counter-torque. Thus, the size and shape of the components are selected in order to achieve a desired counter-torque to keep wing 108 orientated to a desired point of sail, such as between 20 and 22 degrees on either side of the apparent wind. The torque produced by mast 110 is related to the size and shape of wing 108. Generally, as the size of wing 108 increases, the counter-torque necessary to oppose the torque increases. To increase the counter-torque, nose profile 608 and 610 may require a steeper profile, a shorter tension bar 208, and/or a greater spring force of mechanical energy storage means 214 than what is shown in FIG. 6. Similarly, to decrease the counter-torque, nose profile 608 and 610 may comprise a gentler profile, a longer tension bar 208, and/or a weaker spring force of mechanical energy storage means 214 than what is shown in FIG. 6.

| Angle | R | dR | R* sindalpha | Slope (deg) | RS | err const RS | err^2 | Arm Angle | Spring Force | Moment (Counter-Torque) | Mom Err^2 |
|---|---|---|---|---|---|---|---|---|---|---|---|
| 30 | 16.86 | 0.185925 | 0.29440 | 32.273 | 544.42 | 0.70177 | 0.4924 | 18.64 | 49.747 | 2.545E−06 | 2.829E−06 |
| 31 | 17.05 | 0.185708 | 0.29764 | 31.961 | 545.08 | 0.66347 | 0.4402 | 18.83 | 49.807 | 2.414E−06 | 2.683E−06 |
| 32 | 17.24 | 0.185492 | 0.30088 | 31.653 | 545.71 | 0.62642 | 0.3924 | 19.02 | 49.866 | 2.289E−06 | 2.545E−06 |

Where:

Angle=the angle of cam 200 with respect to centerline 624

R the radius of dwell portion 600, left nose profile 608 or right nose profile 610, depending on the Angle. Calcuated as P3 multiplied by the Angle, plus P2 plus the previous Angle dR=the derivative of the Radius, i.e., the difference between successive Radius values R*SindAlpha=the Radius multiplied by the sine of dR Slope=the slope of the cam profile at each Angle, calculated as the arctangent of R*SindAlpha and dR, in degrees RS=the Radius multiplied by the Slope err const RS=the difference between successive RS values err^2=the square of the err const RS ArmAng=the angle of tension bar 208 with respect to the horizontal, calculated as the arctangent of the length of tension bar 208 and the Radius, in degrees Spring Force=force created by mechanical energy storage means 214 against dwell/nose profile at each particular ArmAng Moment (counter-torque)=Counter-torque produced against mast 110 as mast 110 rotates cam 200 at each angle relative to centerline 624, calculated by multiplying the Spring Force by the sine of the Slope (in radians), and then multiplying by the Angle divided by 1000.

Momerr^2=is the difference between successive Moments, squared

The following variables are entered into the spreadsheet:

P2/P3

A torque/force of mechanical energy storage means 214

A length of tension bar 208

A mechanical energy storage means 214 start angle

The spreadsheet varies the parameters P2 and P3 (which determine the progression of the cam slope) to try to minimize the Momerr^2. In other words, the dr terms (P2, P3) are adjusted to produce the least change in the cam torque over the whole angle range (except the 0-20 degree constant segment).

Figure 9:
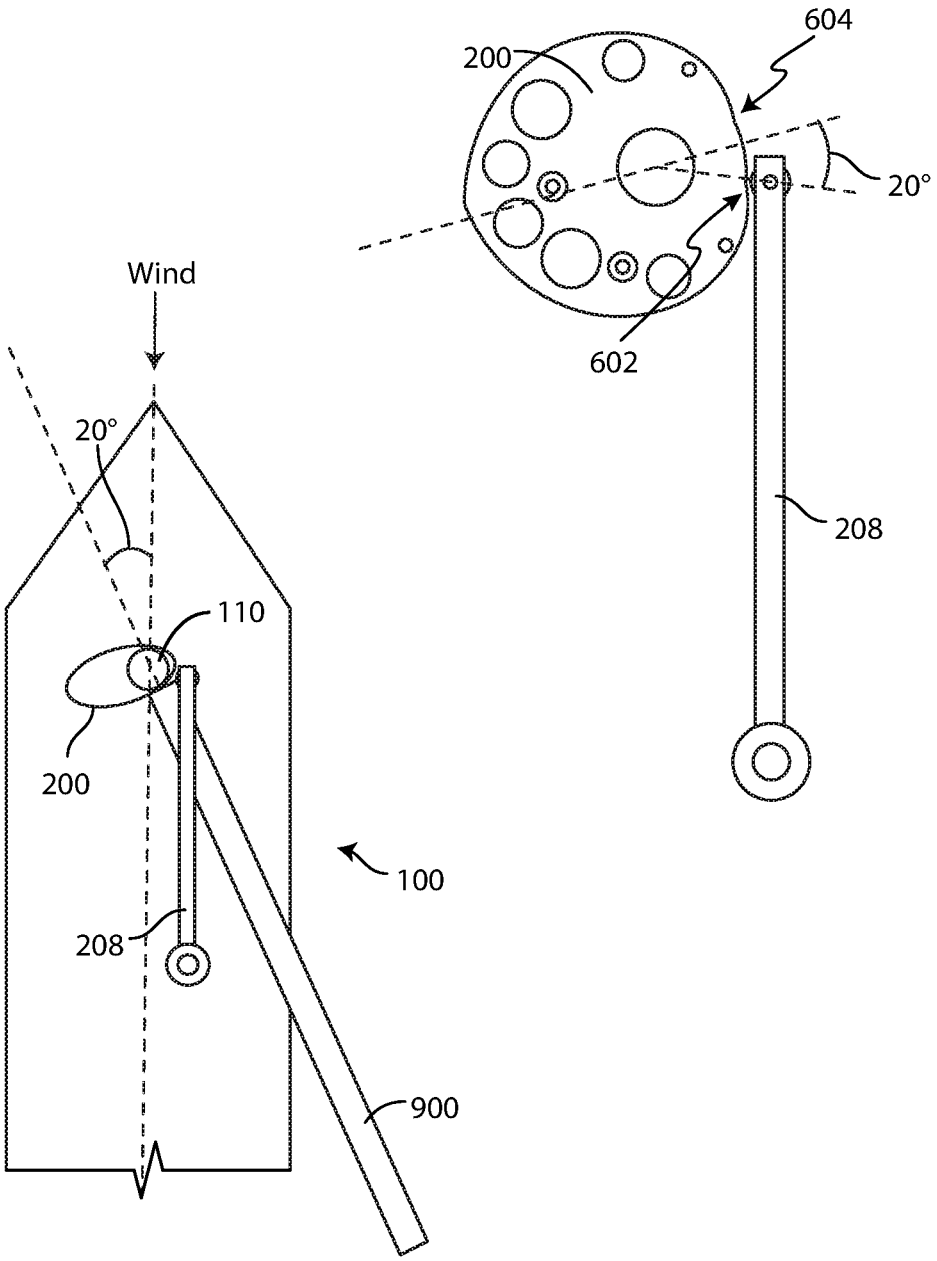
FIG. 9 is a top, plan view of a sailing vessel comprising the automatic, passive, wing-control mechanism as shown in FIGS. 1-6, illustrating a relationship between a wing and the wind, and a close-up view of the cam and a tension bar.

FIG. 9 is a top, plan view of a sailing vessel 100 heading directly into the wind. In this embodiment, sailing vessel 100 comprises a boom 900 attached to mast 110, and fabric is coupled to the mast and the boom to form a sail (not shown). Vessel 100 comprises mechanism 102, i.e., cam 200 and tension arm 208, installed as described previously. Also shown in FIG. 9 is a top, close-up view of cam 200 and tension arm 208, showing the orientation of cam 200 with respect to tension arm 208 as wing 108 is held at a 20 degree male to the apparent wind. Although mast 110 is shown as have been pivoted counter-clockwise, mast 110 could have been rotated clockwise, because mechanism 102 does not produce any torque while boom 900 is within +/−20 degrees from the wind.

Cam 200 is shown being rotated clockwise, in concert with mast 110, at an angle of approximately 20 degrees. At this angle, opposing end 300 of tension bar 208 is in contact with point 602 on left nose profile 608, where a counter-torque is created as a result of point 602, or a point just past point 602 clockwise along left nose profile 608, begins pushing against opposing end 300. The counter-torque is generally the same or slightly greater than a torque created by the mast 110 at any point along the nose profile, as cam 200 is rotated by the mast as the wind acts on the wing.

Figure 10:
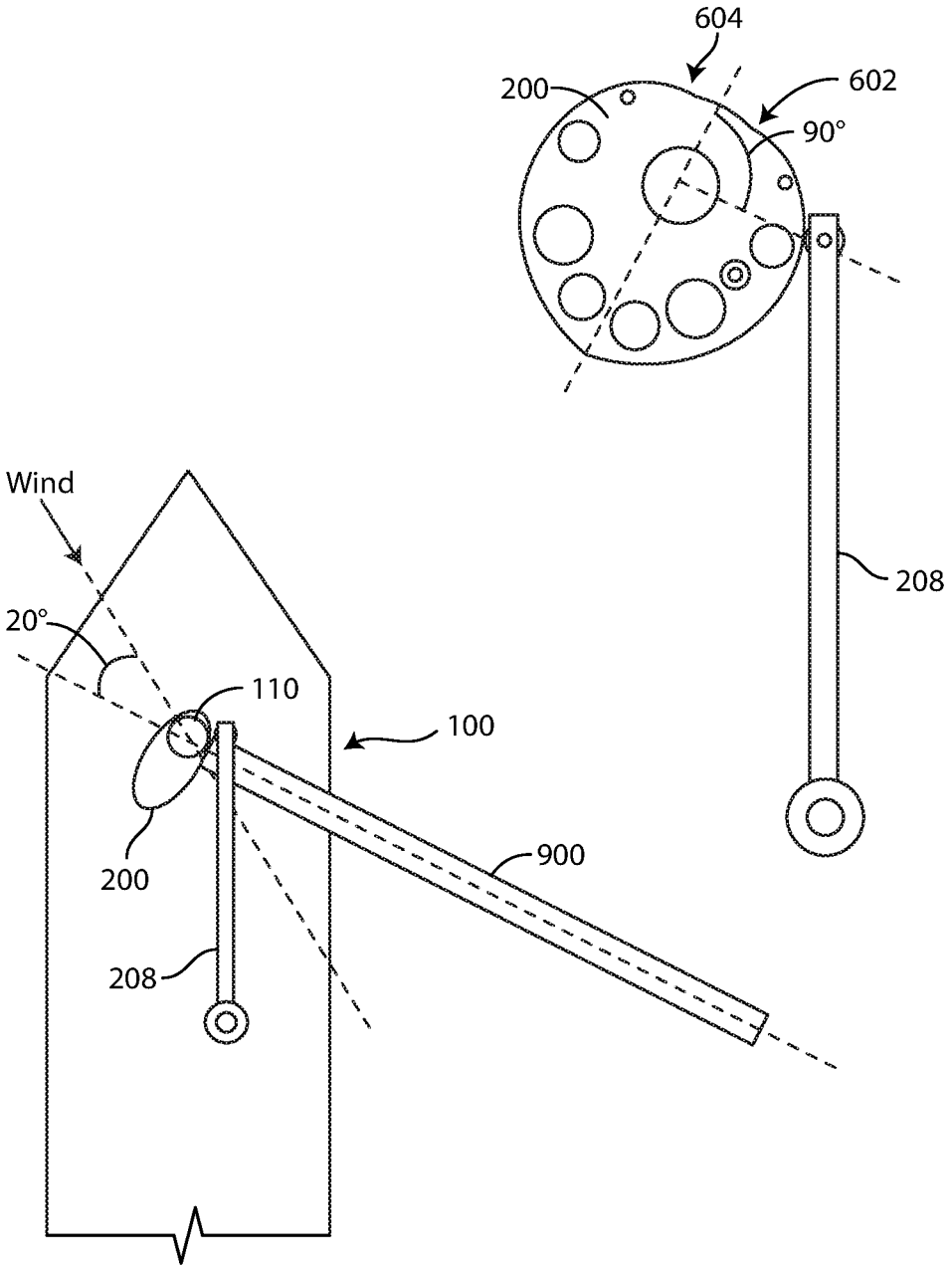
FIG. 10 is a top, plan view of the sailing vessel as shown in FIG. 9, having a wind blowing from port at approximately degrees from the bow, and a close-up view of the cam and the tension bar.

FIG. 10 is a top, plan view of the sailing vessel 100 as shown in FIG. 9, having a wind blowing from port at approximately 40 degrees from the bow. Also shown in FIG. 10 is a top, close-up view of cam 200 and tension arm 208, showing the orientation of cam 200 with respect to tension arm 208 when wing 108 is automatically positioned at the same 20 degree angle with respect to the wind as in FIG. 9. Although cam 200 has been rotated approximately 70 degrees from its orientation in FIG. 9, boom 900 (and therefore wing 108) remains at the same, predetermined angle of 20 degrees with respect to the wind.

Cain 200 is shown being rotated clockwise, in concert with mast 110, at an angle of approximately 90 degrees. At this angle, opposing end 300 of tension bar 208 is in contact with a point on left nose profile 608 about half-way of the length of the left nose profile 608. At this point, mast 110 produces a torque approximately the same as in FIG. 9, and mechanism 102 creates a counter-torque that cancels the torque of mast 110, keeping wing 108 at a steady orientation of 20 degrees of off the wind.

Figure 11:
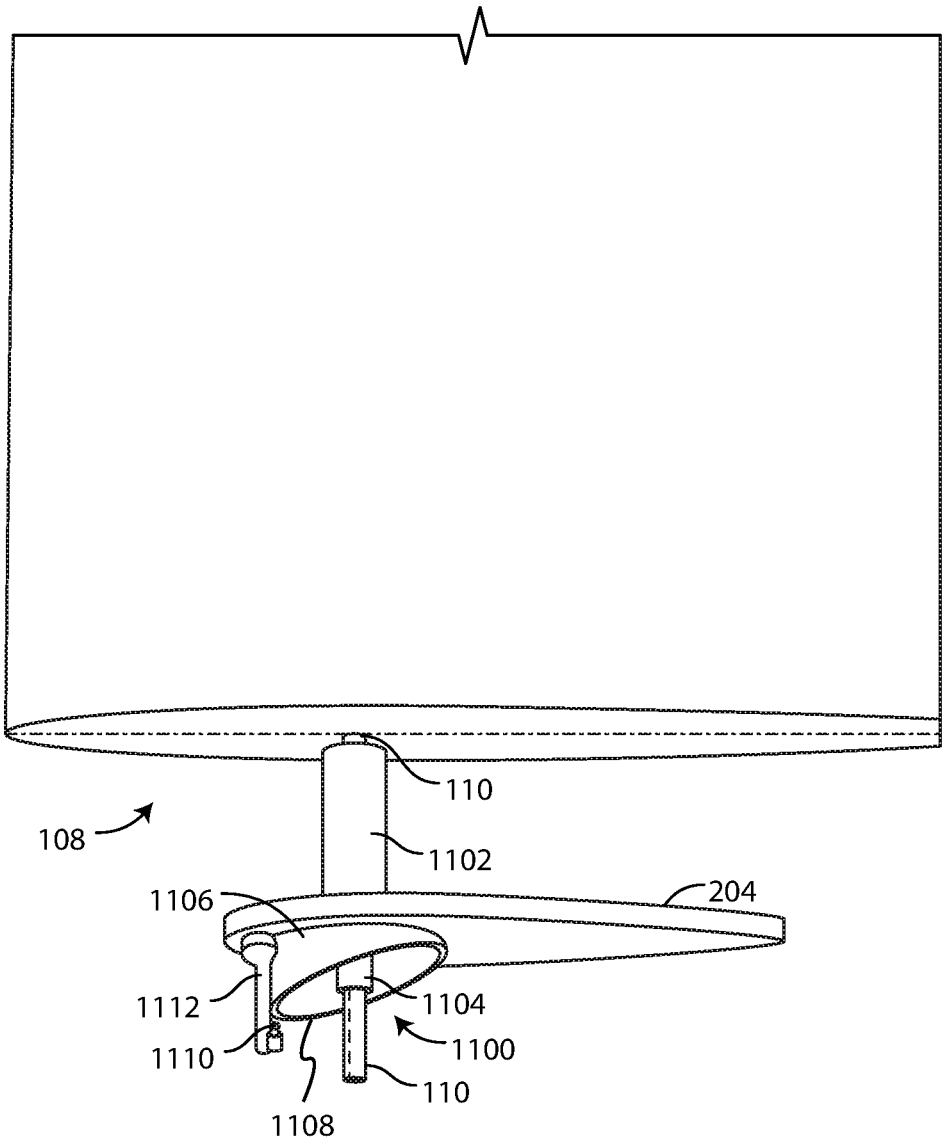
FIG. 11 is a side, perspective view of another embodiment of an automatic, passive, wing-control mechanism.

FIG. 11 is a side, perspective view of another embodiment of an automatic, passive, wing-control mechanism 1100 used to automatically position wing 1102 into a predetermined angle with respect to the apparent wind. In this embodiment, mechanism 1100 is rotatably mounted to an underside of deck 204. Deck 204, as shown in FIG. 11, comprises a small, rigid platform to support wing 108 in an embodiment where deck 204 is used in a configuration with the submerged sailing vessel as shown in FIG. 1. In other embodiments, deck 204 forms a deck of a typical sailboat, catamaran, or other sailing vessel.

Mast 110 is placed through an upper sleeve 1102, which extends upwards from a top surface of deck 204. In some embodiments, upper sleeve 1102 may form part of mechanism 1100 or, in other embodiments, it may be formed separately on the top surface of deck 204. In either case, a hole is formed through deck 204 in alignment with upper sleeve 1102, sized and shaped to allow mast 110 to pass. Upper sleeve 1102 is typically manufactured from a hard, durable material such as metal or plastic.

FIG. 11 shows how mast 110 extends through upper sleeve 1102 and through lower sleeve 1104, exiting from lower sleeve 1104. Lower sleeve 1104 and upper sleeve 1102 may be formed as a unit, having a similar inside diameter while each sleeve may have a similar, or different, external diameter, as is the case as shown in FIG. 11. Mast 110 is fixedly coupled to at least lower sleeve 1104, such as one or more traditional screws, bolts rivets, adhesives, etc., so that mast 110 is fixed in relation to sleeve 1104 and/or sleeve 1102 as the wind acts upon wing 108, subject to a counter-torque generated by mechanism 1100, as described below.

Mechanism 1100 further comprises a lobe 1106 comprising a profile, or a sloped edge 1108 that rides on top of roller 1110. Roller 1110 is coupled to bracket 1112, which is affixed underneath deck 204 to hold roller 1110 in a fixed position with respect to lobe 1106. In one embodiment, roller 1110 comprises a rotatable bearing provides a low-friction interface with profile 1108. In other embodiments, roller 1110 may comprise, simply, a material that comprises a low coefficient of friction, such as polished metal. The weight of at least mast 110 exerts a downward force on lobe 1106, forcing sloped edge 1108 to contact the roller. The slope of edge 1108, along with the weight of at least mast 110 generates a constant restoring torque to mast 110 that automatically holds mast 110, and wing 108, in a predetermined orientation with the wind.

When the mast wing is rotated by the wind or by a change in orientation of a vessel, lobe 1106 rotates in concert with mast 110, causing lobe 1106 to travel longitudinally up or down as sloped edge 1108 is forced against roller 1110 at various points along sloped edge 1108. As lobe 1106 moves longitudinally, mast 110/wing 108 also moves longitudinally in concert with lobe 1106.

Mechanism 1100 is designed to hold wing 108 in a desired angle to the wind, typically in a "close hauled" position, where wing 108 is held as close to the wind as possible without entering a no-go zone of sailing, typically between 18 and 25 degrees, when sailing into the wind. As shown in FIG. 11, wing 110 is positioned at a 90 degree angle with respect to a longitudinal axis of the vessel (i.e., from bow to stern) when the apparent wind is blowing against wing 108 at an angle of 70 degrees from the longitudinal axis. In other words, wing 108 is held into a desired orientation of about 20 degrees to the apparent wind. In this position, a torque is applied to mast 110 by the wind acting against wing 108, but an equal and opposite counter-torque is generated by lobe 1106 by way of the weight of mast 1111/wing 108 pushing downward and the slope of sloped edge 1108 at a point along sloped edge 1108 as shown in FIG. 11.

Figure 12:
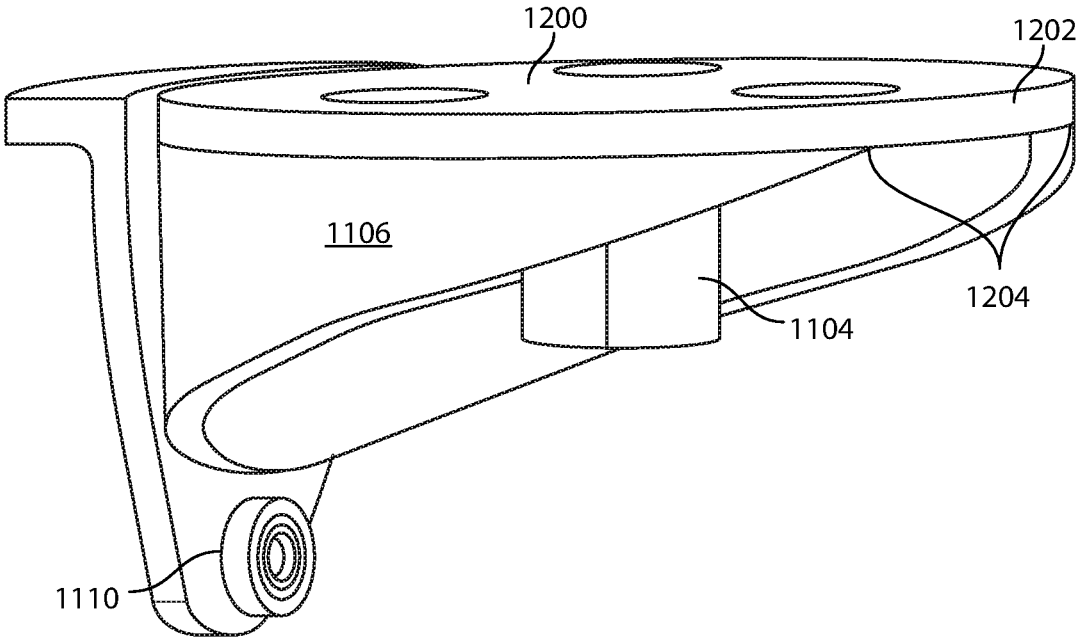
FIG. 12 is a close-up, perspective view of the automatic, passive, wing-control mechanism of FIG. 11.

As best shown in FIG. 12, sloped edge 1108 comprises a perimeter that varies in height from base 1200 of lobe 1106, as a function of an angle from edge point 1202. The slope of sloped edge 1108 is generally symmetrical in either direction, clockwise or counter-clockwise, from point 1202. Sloped edge 1108 is formed to generate a constant counter-torque to mast 110 as mast 110 is rotated by the wind acting on wing 108. The height of lobe 1106, forming sloped edge 1108, is calculated similar to the process used to calculate the radius of left/right nose profile 608/610 of cam 200 as shown in FIG. 6, substituting the weight of mast 110/wing 108 for the force of mechanical energy storage means 214.

When wing 108 is in the no-go orientation with respect to the wind, i.e., +20 degrees and −20 degrees, there is generally no torque applied mast 110, either by the wind, or by lobe 106, as a flat portion 1204 of sloped edge 1108 is in contact with roller 1110. Eventually, wing 108 will move into the +20 or −20 degree position, for example, by an orientation of the vessel changing due to waves, wind, or currents, and at this angle, roller 1110 begins to generate a counter-torque equal and opposite to a torque applied to mast 110 by the wind, now acting partially on wing 108. In another embodiment, the counter-torque may he slightly smaller or greater than the torque generated by the wind. Thus, mast 110/wing 108 is held at the 20 degree angle or thereabouts. As the wind changes direction, increasing from 20 degrees to 180 degrees, lobe 1106 rotates with mast 110 to maintain the desired angle, i.e., 20 degrees. As lobe 1106 is rotated by the mast, the interaction of roller 1110 and the sloped edge 1108 cause an approximate equal counter-torque to mast 110, excluding flat portion 1204. The counter-torque is generally constant as lobe 1106 is rotated by mast 110. Thus, wing 108 is held at 20 degrees from the apparent wind automatically, and without human intervention, and without the use of motors, pulleys, or hydraulics.

Figure 13:
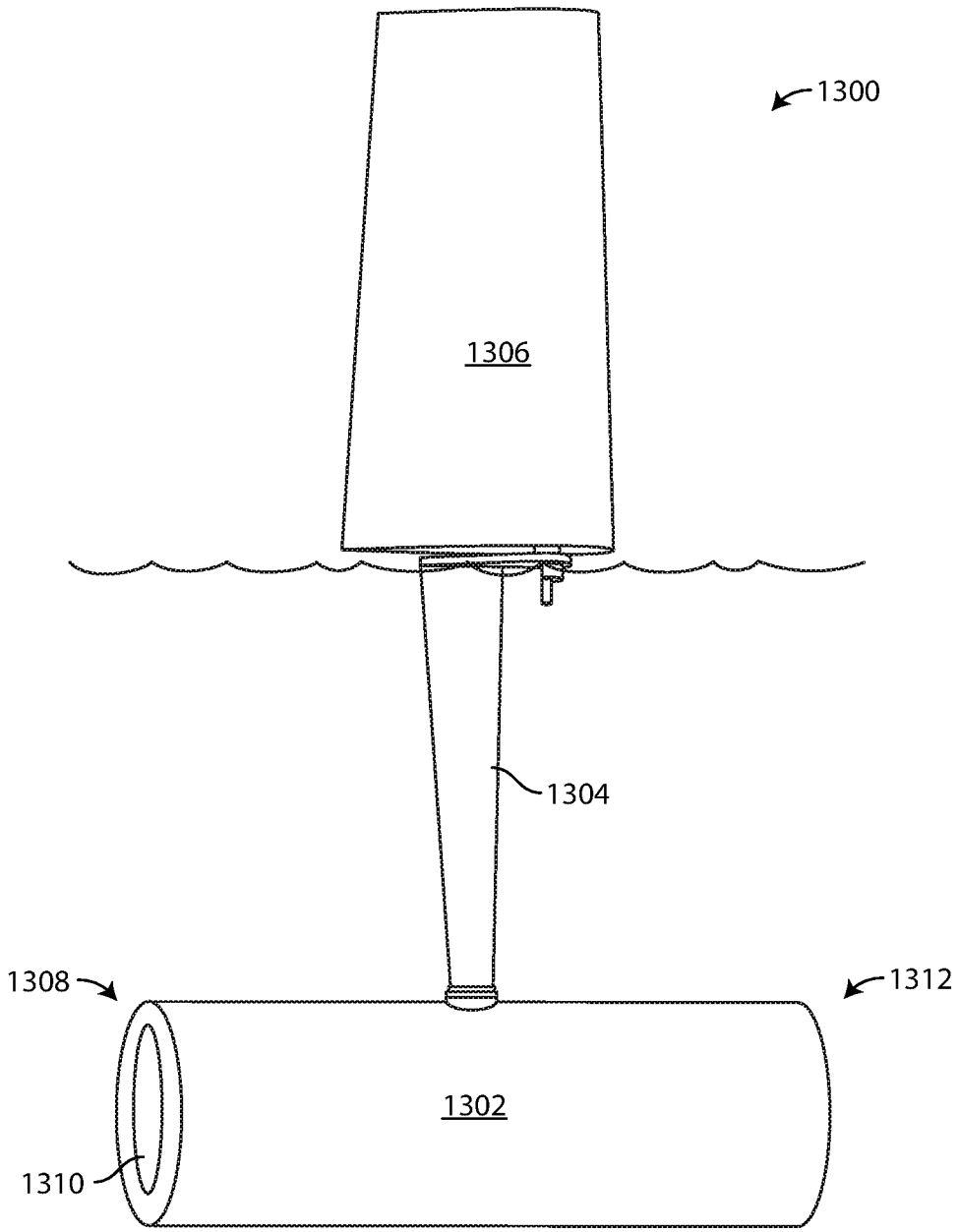
FIG. 13 illustrates one embodiment of an underwater docking station that may utilize one of the automatic, passive wing-control mechanisms as shown in FIGS. 1-3 or FIGS. 11-12.

FIG. 13 illustrates one embodiment of an underwater docking station 1300 that may utilize one of the automatic, passive wing-control mechanisms as described previously herein. Underwater docking station 1300 is configured to receive and retain an underwater vessel, such as an autonomous underwater vehicle (AUV). Such an AUV may comprise an unmanned or manned underwater vessel having a need to recharge its power source and/or communicate with a remote location. AUVs are typically powered by one or more rechargeable batteries which drive a propulsion device, typically in the form of one or more electric motors that drive one or more propellers located at the aft end of the craft. The batteries typically provide power for other electronics onboard the AUV, such as lights, computers, recording equipment, communications equipment, etc.

In the embodiment shown in FIG. 13, underwater docking station 1300 comprises retainer 1302 coupled to keel 1304, which in turn is coupled to wing 1306 which propels underwater docking station 1300 through the water as wind acts on wing 1306. Underwater docking station 1300 operates on principles similar to those of a submerged sailing vessel as described by U.S. Pat. No. 10,029,773, referenced previously herein, comprising a hull coupled to a keel, which is in turn coupled to a wing.

In general, underwater docking station 1300 itself is heavier than its displacement and would sink. However, keel 1304 is lighter than water, and thus provides the necessary buoyancy to keep underwater docking station 1300 from sinking. Keel 1304 is also shaped aerodynamically so that it will resist a sideforce created by wing 1306 above when underwater docking station 1300 is moving. Keel 1304 then performs three functions: it provides the necessary flotation, it counteracts the sideforce created by wing 1306 and it supports wing 1306.

Wing 1306 above acts like a traditional sailing wing, providing lift to propel underwater docking station 1300 through the water. The generated lift also creates a sideforce which is counteracted by keel 1304. Also, the wind force on wing 1306 also creates a rolling moment which must be counteracted or underwater docking station 1300 will tend to roll over. This righting moment is created by virtue of the fact that there is a center of gravity (primarily the weight) of underwater docking station 1300 below the water surface, and a center of buoyancy (from the buoyant keel) near the water surface. When underwater docking station 1300 rolls somewhat, the center of gravity gets displaced laterally from the center of buoyancy, and there is a restoring, righting moment created.

An additional feature of this arrangement of underwater docking station 1300, i.e., keel 1304 above retainer and wing 1306 above keel 1304, is that the keel's aerodynamic counteracts the sideforce on wing 1306 to help to provide additional righting moment to underwater docking station 1300, which is a benefit compared with the traditional sailing vessel, wherein the keel always adds to the rolling moment.

Either or both keel 1304 or wing 1306 may be inflatable and derive some or all their structural properties and aerodynamic shapes from the fact that these devices are pressurized, either by a pump or storage tank or by the flow and pressure of the incident wind as in a ram air hang glider or kite wing. This inflation could also be used to supply or to augment the flotation requirements of underwater docking station 1300.

In one embodiment, wing 1306 and/or keel 1304 may be positionable in either a functioning state or an inactive state, i.e., such as stowed, folded, furled, or deflated, for example, and thereby reducing its influence on the vessel. This embodiment would be useful, for example, to make use of the a sailing mode at times (i.e., with wing 1306 activated), but at other times be able to dive and maneuver fully underwater, in which case it would be beneficial for wing 1306 and keel 1304 to ideally be absent, but practically such that they didn't provide additional drag, or forces or moments to underwater docking station 1300. This system could be implemented in a number of ways, such as, (but not limited to) folding wing 1306 down, or deflating it and putting it into a container.

In one embodiment, underwater docking station 1300 may be configured to primarily loiter or to hold station in open water. In other words, in this embodiment, underwater docking station 1300 is designed to be movable enough to be able to sail relatively short distances back and forth to essentially remain in one location. This approach may be used to wait for AUVs indefinitely to provide recharging and/or communications, and a plurality of underwater docking station 1300 could be deployed over a large geographic area to provide a network of recharging and/or communication stations, each underwater docking station 1300 "patrolling" a particular geographic area.

Figure 15:
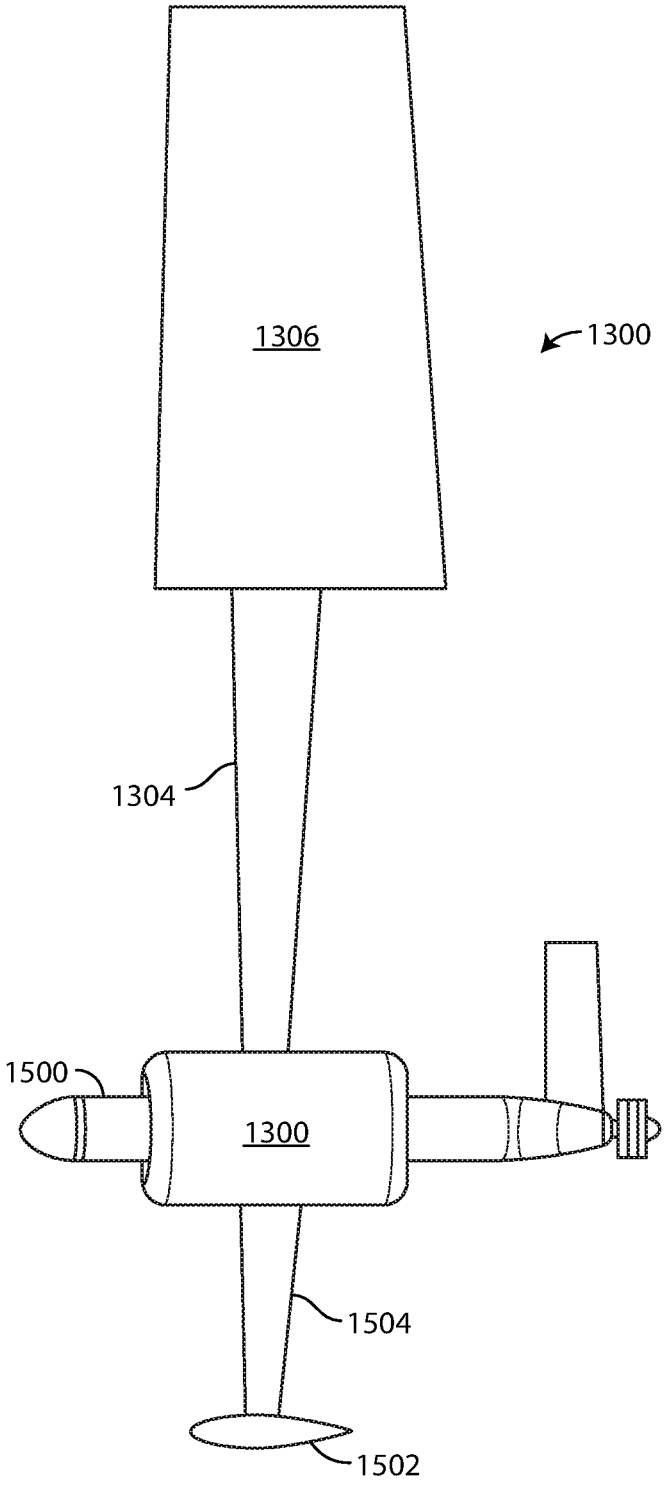
FIG. 15 is a side view of the underwater docking station as shown in FIG. 13 holding an autonomous underwater vehicle.

In one embodiment, as shown in FIG. 15, underwater docking station 1300 comprises one or more ballast tanks 1502 that can be filled with water or emptied so as to control the buoyancy of underwater docking station 1300. This control could he used to raise or lower underwater docking station 1300 in the water's depth and to bring underwater docking station 1300 to the surface for access. In addition, these ballast tanks could be moveable, provided with suitable mechanisms, to be positioned to improve vessel stability while on the surface, or to reduce drag while under water. These tanks could be either internal to the underwater docking station 1300's body or external.

As mentioned earlier, underwater docking station 1300 comprises retainer 1302 for receiving and retaining one or more AUVs. In the embodiment shown in FIG. 13, retainer 1302 comprises a hollow cylinder, having an open end 1308 and a void 1310 that receives one or more AUVs. Underwater docking station 1300 is typically neutrally-buoyant, such that retainer 1302 remains below the surface of the water. Underwater docking station 1300 may operate in either fresh or salt-water environments. Buoyancy is determined by a number of factors, such as the weight of retainer 1302, ballast, keel 1304, wing 1306, electronic/communications equipment, and displacement of the under-water components.

It should he understood that although underwater docking station 1300 shown in FIG. 13 comprises a single retainer, in other embodiments two or more retainers could he utilized to accommodate simultaneous docking of multiple AUVs. In these embodiments, two or more retainers could be configured as an array of retainers, joined together in any number of arrangements, such as a single row or column of retainers, or an array of retainers comprising a number of rows and columns. Each of the retainers would comprise recharging and/or communications capabilities for a single AUV.

In a related embodiment, underwater docking station 1300 could be configured to deploy one or more AUVs. In one embodiment, multiple retainers are attached to keel 1304, each retainer provisioned with one or more AUVs programmed to carry out a particular task. Underwater docking station 1300 may then be launched with preprogrammed instructions to maneuver to one or more particular locations. When underwater docking station 1300 reaches a particular location, one or more of the AUVs may be deployed. After each AUV has completed its assigned task, or when each AUV needs recharging, each may return to underwater docking station 1300 and seek an empty retainer, where it may once again be retained for recharging and communication purposes.

In another embodiment, multiple UUVs (umnanned underwater vehicles) and/or other deployable assets are carried by a cargo vessel internally and/or externally and deployed once the vessel reaches locations of interest. The vessel may additionally carry one or more underwater docking station 1300*s*. UUVs may be deployed in the vicinity of the underwater docking station 1300*s*, or the UUVs may be deployed along with or from one or more underwater docking station 1300*s* carried by the vessel. ROVs (remotely operated vehicles) may be tethered and deployed from cargo vessels and/or docking stations. Similar to above, when an AUV (autonomous underwater vessel) needs recharging or is in need of communicating with the deploying or host vessel or a land-based location, it may seek a docking station in order to recharge and/or communicate. Each docking station may comprise one or more retainers, each retainer capable of offering recharging and/or communications to the AUVs. After the AUVs have either individually or collectively completed their task, one of the AUVs may be tasked to dock with a underwater docking station 1300 to send a message to the vessel or land-based location indictintively, such, and that the AUVs are ready for pick-up by the vessel. In response, the vessel may be dispatched to pick up the AUVs and/or underwater docking station 1300(*s*).

Figure 14:
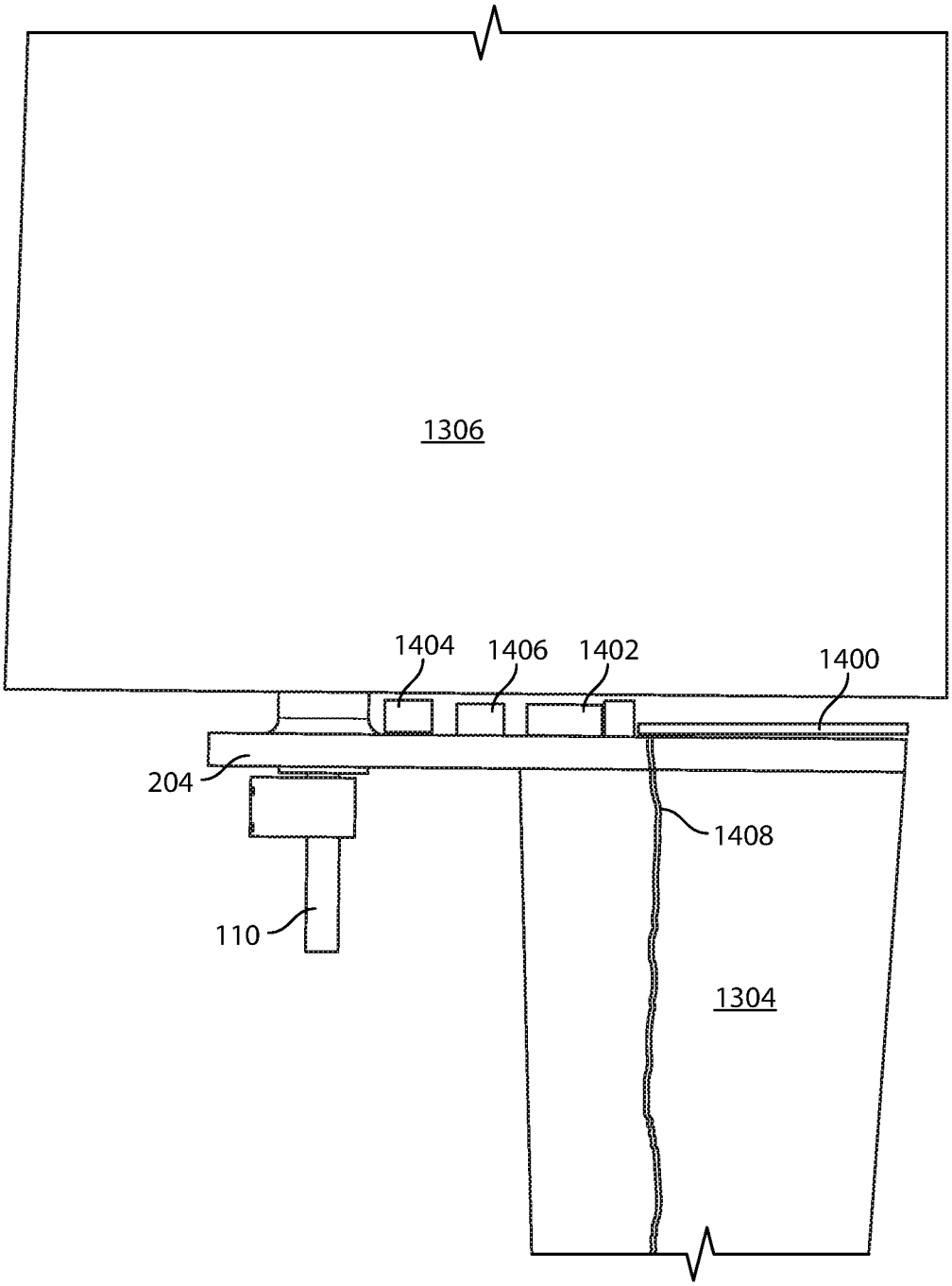
FIG. 14 is a close-up, side view of a deck located between a wing and a keel of a submerged sailing vessel, illustrating various electronic and power components of the underwater docking station as shown in FIG. 13.

FIG. 14 is a close-up, side view of one embodiment of underwater docking station 1300 comprising a deck 204 located between wing 1306 and keel 1304, comprising solar array 1400, transceiver 1402, processing device 1404, power circuitry 1406, and power and/or communication cable 1408. In another embodiment, one or more of these components could be located within keep 1304 or retainer 1302. Processing device 1404 provides general control over underwater docking station 1300, such as to control communications, navigation, and docking activities. Processing device 1404 comprise a computer that executes one or more computer programs to perform these functions. Processing device 1404 may be in communication with a position location device (such as a GPS antenna/receiver), where the processing device 1404 may cause a rudder to turn into a position such that underwater docking station 1300 travels in a circular motion, thereby limiting its movement to a limited area. The processing device 1404 may also cause the docking station to be propelled forward via thruster 122. In another embodiment, processing device 1404 may cause underwater docking station 1300 to patrol along a limited travel route, such as in an oval course of one or more hundred yards, using the GPS antenna/receiver and a selected propulsion method. In an embodiment where both wind and propeller propulsion are available, processing device 1404 may select one or more of the propulsion methods based on a fuel level or battery charge detected by processing device 1404, where only wing 1306 is used when the fuel or battery level is less than a predetermined threshold. Additionally, processing device 1404 may be configured to allow docking station 1300 to drift, and periodically bring docking station 1300 back to an intended location when processing device 1404 determines that underwater docking station 1300 has been displaced from the intended location by more than a predetermined distance.

Solar array 1400 may comprise one or more solar panels or solar cells located on top of deck 204, and/or incorporated into the fabric or structure of wing 1306, as described in pending U.S. patent application Ser. No. 16/117,452 entitled "Solar Wing System and Apparatus", assigned to the assignee of the present application and incorporated by reference herein in its entirety.

The power generated by solar array 1400 may be provided to a battery charge controller, where the battery charger recharges a battery as part of power circuitry 1406 located on deck 204, or within retainer 1302. In another embodiment, batteries are not used, and power from solar array 1400 is provided either directly from solar array 1400 to an AUV for recharging, or it is provided to a charge controller and then to an AUV. In another embodiment, underwater docking station 1300 comprises an inverter for converting DC power from a battery of power circuitry 1406 to AC power for use by retainer 1302 and/or an AUV docked within retainer 1302. When an AUV is docked inside retainer 1302, the AUV's batteries are charged by inductive coupling between an inductor embedded in retainer, or located within retainer 1302, and another inductor located on the AUV.

Retainer 1302 is configured to receive and retain an AUV while it is recharging or communicating with a remote entity, such as AUV 1500 as shown in FIG. 15. In this embodiment, retainer 1302 comprises is a hollow cylinder, having two open ends: end 1308 and an opposing end 1312, as shown in FIG. 13. Underwater docking station 1300 may also comprise ballast 1502 coupled to retainer 1302 via strut 1504. Ballast 1502 provides for lateral stability of underwater docking station 1300. The ballast's size, weight, displacement and distance from retainer 1302 are all design considerations that are used to calculate a side-force necessary to keep underwater docking station 1300 upright under worse-case wind conditions.

In this configuration, AUV 1500 may enter or leave retainer 1302 in either direction. In another embodiment, one end is sealed so that AUV 1500 can only enter from one end. Having retainer 1302 open at both ends, however, advantageously allows AUV 1500 to enter at one end, and exit through the other. This may be desirable, as AUV 1500 would not need a capability of reverse propulsion to exit retainer 13132. In some embodiments, retainer 1302 may have an outer cross-section of any geometric shape while having in inner cross-section different than the outside cross-section, such as an outer cross-section in the form of a square and an inner cross section in the form of a circle.

Various methods may be employed to allow the AUV to enter retainer 1302 and then to retain it, such as in an embodiment where retainer 1302 comprises one or more inflatable bladders located inside retainer 1302, or extendable knobs, extensions, or other physical structures that "seize" the AUV by extending from an interior surface of retainer 1302 after an AUV has entered retainer 1302.

In one embodiment, after AUV 1500 has docked with retainer 1302, AUV 1500 communicates with processing device 1404 via cable 1408. In an embodiment where processing device 1404 is located on deck 204. In other embodiment, where processing device 1404 is located onboard retainer 1302, processing device 1404 provides signals to transceiver 1402 for transmission by transceiver 1402 to a remote location using wireless communication technology, such as cellular, satellite, or some other wireless communication technology. Typically, transceiver 1402 comprises a well-known transmitter and receiver in combination with each other. AUV 1500 may provide information pertaining to a status of AUV 1500, such as a battery level, charging parameters (i.e., AUV 1500 requires a charge of 12 volts DC, with a maximum amperage of three amps and a capacity of 50 amp-hours), or mission data, such historical information regarding the location, depth, speed, of underwater docking station 1300, digital photographs/video, etc. In response, processing device 1404 can cause a power circuitry 1406 to adjust its power charging settings to accommodate AUV 1500's particular charging requirements.

Transceiver 1402 may additionally comprises electronic communication circuitry for allowing wireless communications between AUV 1500 and underwater docking station 1300, or, in another embodiment, a separate communication device may be located within retainer 1302. This communication circuitry may comprise a one-way or bi-directional short-wave radio, acoustic communication technology, a light transmitter/receiver, or any communication circuitry allowing wireless communications through the water from retainer 1302 to AUV 1500, either while AUV 1500 is outside of retainer 1302 or inside.

In another embodiment, communications between underwater docking station 1300 and AUV 1500 may be accomplished using wired techniques. For example, in one embodiment. AUV 1500 comprises a mechanical receptacle for receiving a mating mechanical protrusion located within retainer 1302, i.e., located on an inside surface of an end cap of retainer 1302, i.e., in an embodiment where retainer 1302 comprises only one open end. A wet matable connector is located inside the mechanical receptacle, which aligns with a reciprocal matable connector located at the end of the mating mechanical protrusion. The wet matable connectors join as AUV 1500 is propelled forward into retainer 1302, stopping when the mechanical receptacle and the mating mechanical protrusion have fully interlocked. The wet matable connectors allow AUV 1500 to communicate with processing device 1404 via one or more wires. In another embodiment, short-range wireless technology is used when AUV 1500 enters retainer 1302 (or is within range of the short-range technology located on underwater docking station 1300). When both short-range wireless transceivers are within range of each other, communications may be initiated.

In operation, AU 1500 may be on assignment in open water, such as a sea, lake or the ocean. AUV 1500 may be conducting oceanographic studies, fish stock studies, marine life studies, monitoring of water temperatures, currents, visibility, or one or more of a variety of other tasks. AUV 1500 may be configured to determine when it is in need of recharging, by monitoring a battery level used to power the AUV, either for propulsion, general electronic needs, or both AUV 1500 may make this determination based on a target location that has been programmed into AUV 1500, and determining, based on a battery charge level, that it either cannot reach the intended target location, or that it cannot reach the target location and return to a return location. AUV 1500 may take into consideration recent operating conditions, such as its progress in the water for predetermined time, such as a previous hour of operation. Such progress may be determined by factors such as current, depth, water temperature, maximum rated speed of AUV 1500, and/or other factors.

AUV 1500 may, alternatively or in addition, determine that it is in need of communications with a remote entity, such as a land-based transceiver in charge of its task. This may be determined by monitoring a memory to determine when the memory is full or nearly so, so that AUV 1500 can off-load data collected by AUV 1500 and stored in the memory. AUV 1500 may also be configured to "check in" with a land-based transceiver at predetermined intervals, such as once every twenty-four hours for a status check. AUV 1500 may also determine when a mechanical or electronic problem exists and be programmed to report such anomalys to the remote location.

When AUV 1500 determines that it is in need of recharging or communications, it may enter a "seek" mode of operation, where AUV 1500 searches for a underwater docking station 1300. AUV 1500 may be pre-programmed with the locations of one or more underwater docking station 1300, for example, one or more GPS coordinates, each referencing a particular underwater docking station 1300. In one embodiment, each location additionally comprises other information, such as the communications and/or recharging capabilities of each underwater docking station 1300. AUV 1500 may use this other information to select a particular underwater docking station 1300 based on the needs of AUV 1500 and the capabilities of the available underwater docking station 1300.

In any case, AUV 1500 selects a particular underwater docking station 1300, in one embodiment, based on the distance between AUV 1500 and each underwater docking station 1300. After selection, AUV 1500 proceeds on a course to rendezvous with the selected underwater docking station 1300. In some embodiments, one or more underwater docking station **1300*s* may be equipped with a visual or electro-magnetic, beacon that provides signals to AUVs in order to help them more easily find the underwater docking station 1300*s*. The signal produced by the beacon may be detectable by AUV 1500 for a relatively short distance, such as fifty feet, in light of a power budget of each underwater docking station 1300**.

When AUV 1500 approaches underwater docking station 1300, underwater docking station 1300 may be alerted to the AUV's presence by detecting a sonic or electro-magnetic signal produced by AUV 1500, or by visual means. AUV 1500 may activate this signal when it detects that it is near underwater docking station 1300, as determined by reception of the underwater docking station 1300's beacon signal, by using visual means or AUV 1500 may transmit it's sonic or electro-magnetic signal constantly or at predetermined time intervals, such as once per minute.

Once AUV 1500 detects underwater docking station 1300, it may attempt communications with a remote, land or ship-based remote location if it does not need recharging, but is in need of transmitting or receiving information from the remote location. This may be accomplished through wireless transmission techniques, discussed earlier.

AUV 1500 approaches underwater docking station 1300 using techniques discussed above and/or known in the art, and in the embodiment shown in FIG. 15, aligns itself with one of the open ends of retainer 1302. AUV 1500 then propels itself into an open end until it is grasped by the retainer, again using techniques already discussed. Retainer 1302 may comprise one or more sensors to determine a position of AUV 1500 as AUV 1500 travels inside retainer 1302 and the processing device 1404 may activate retaining means when processing device 1404 has determined that AUV 1500 is in a predetermined location within retainer 1302. A particular, predetermined location may be necessary to ensure that any short-range wireless communication between underwater docking station 1300 and AUV 1500 are successful.

Once AUV 1500 has successfully docked, as indicated by the one or more sensors and/or a determination that the grasping mechanism(s) have engaged AUV 1500, a signal may be provided to processing device 1404 indicating such.

After notification that AUV 1500 has docket successfully, processing device 1404 may begin to cause power circuitry 1406 to charge AUV 1500's battery(s), as described above.

After charging is complete, AUV 1500 may send a notification to processing device 1404, indicating such. In another embodiment, processing device 1404 determines that AUV 1500 is charged by determining that a charge current has dropped below a predetermined threshold. In response, processing device 1404 may terminate charging.

AUV 1500 may further provide an indication to processing device 1404 that all of its data intended for the remote location has been successfully provided to processing device 1404. Similarly, processing device 1404 may receive notification from the remote location that no further communications are necessary with AUV 1500.

In either, or both, cases, above, processing device 1404 releases AUV 1500 by sending control signals to the grasping mechanism. In response, the grasping mechanism releases AUV 1500 and may provide confirmation to processing device 1404 that AUV 1500 has, in fact, been released. In response, processing device 1404 may send AUV 1500 a wireless notification that AUV 1500 has been released. AUV 1500 may then start its propulsion system and exit out of the retainer to continue its task.

Figure 16:
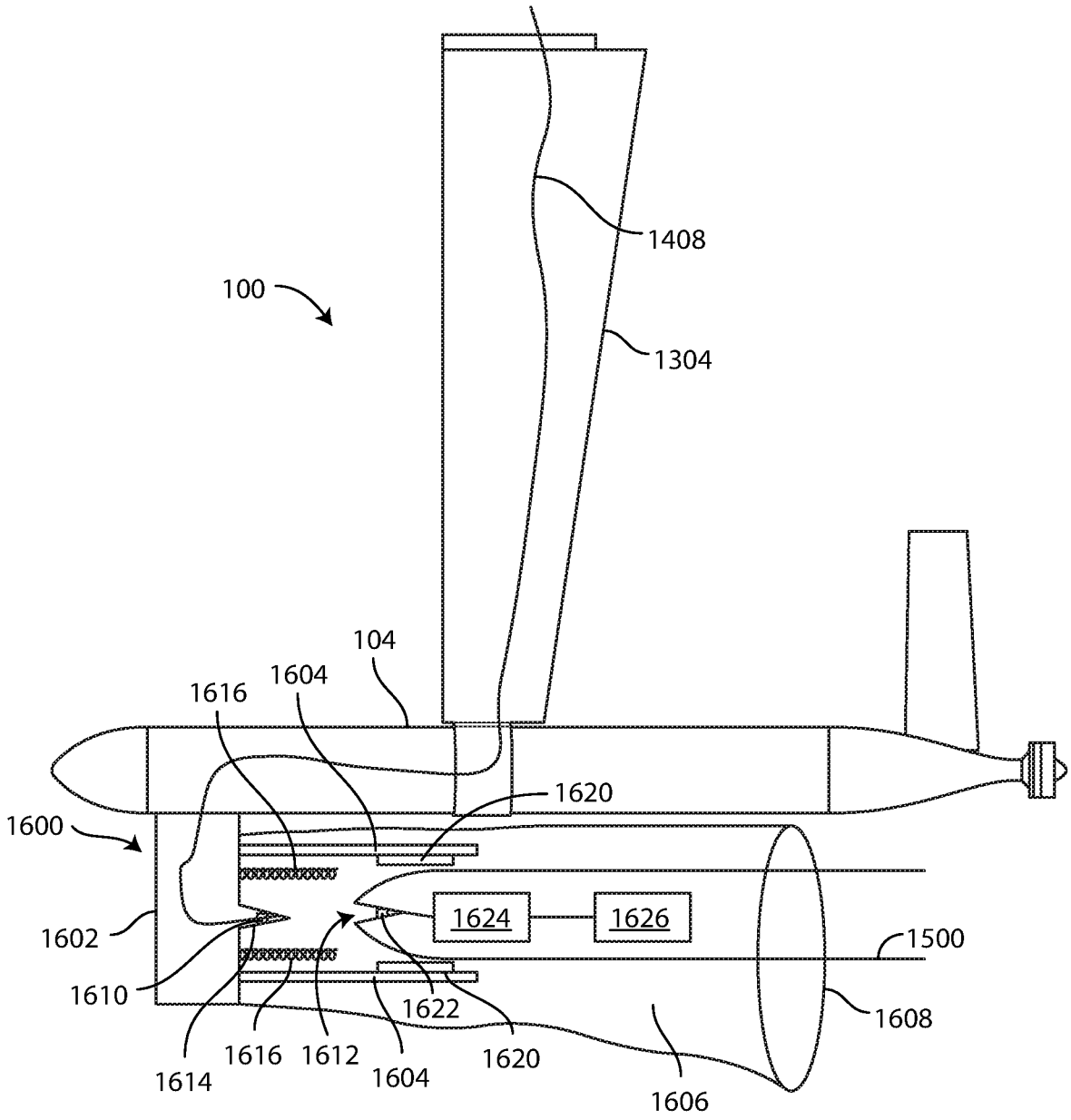
FIG. 16 is a side view of another embodiment of an underwater docking station, illustrating a capturing system coupled to a sailing vessel such as the one shown in FIG. 1.

FIG. 16 is a side view of another embodiment of underwater docking station 1300, illustrating a capturing system 1600 coupled to a sailing vessel 100 such as the submerged sailing vessel shown in FIG. 1. Not shown in FIG. 16 is a wing coupled to keel 1304, while AUV 1500 is only shown partially, for purposes of focusing on capturing system 1600.

In this embodiment, capturing system 1600 is affixed to the bottom of hull 104, comprising end block 1602, receiving tube 1604, and guiding structure 1606. In this embodiment, AUV 1500 enters capturing system 1600 via guiding structure 1606, which may comprise a "tube" of netting or other pliable material, defined on one end by a rigid or semi-rigid hoop 1608 and the other end coupled to end block 1602. Guiding structure 1606 is configured to guide AUV 1500 towards mating block 1602, which comprises a protrusion 1610 formed in the shape of a cone. In other embodiments, the shape of protrusion 1610 may take other forms. Protrusion 1610 is shaped to receive a depression 1612 formed into the nose of AUV 1500 which, together, hold AUV 1500 in place with respect to end block 1602.

Protrusion 1610 comprises one half of a wet matable connector 1614 coupled to communication/power cable 1408, which is coupled to one or more of transceiver 1402, processing device 1404 and/or power circuitry 1406 located, in this embodiment, on the wing (not shown). In another embodiment, one or more of these components could be located within hull 104.

End block 1602 may further comprise one or more dampeners 1616, such as springs or elastic material, to slow AUV 1500 as it approaches end block 1602. Receiving tube 1604 may comprise one or more magnetic locks 1620 to additionally hold AUV 1500 in position near end block 1602 during charging and/or communications.

Depression 1612 of AUV 1500 comprises a mating half of a wet matable connector 1622 that connects with connector 1614 on protrusion 1610 to provide a wired connection between components inside AUV 1500, such as an onboard computer 1624 and/or battery 1626.

In operation, AUV 1500 may be in need of charging or communications as it navigates through open water. AUV 1500 may determine a location of underwater docking station 1300 as shown in FIG. 16 and align a nose end of AUV 1500 with hoop 1608. Once aligned with hoop 1608, AUV 1500 slowly propels itself into guiding structure 1606. Guiding structure 1606 aids depression 1612 to align with protrusion 1610. The nose end of AUV 1500 enters receiving tube 1604, moving forward and is slowed when the nose encounters dampener 1616. AUV 1500 continues moving forward, approaching end block 602 until protrusion 1610 meets with depression 1612, where the wet mating connectors connect with each other. Magnetic lock 1620 may be activated, or it may be a simple magnet not in need of activation, thereby securing AUV 1500 to hull 104. Once secured, communications and/or charging may begin, via cable 1408, as described earlier herein.

While the foregoing disclosure shows illustrative embodiments of the invention, it should be noted that various changes and modifications could be made herein without departing from the scope of the invention as defined by the appended claims. Furthermore, although elements of the invention may be described or claimed in the singular, the plural is contemplated unless limitation to the singular is explicitly stated.

I claim:

1. A mechanism to automatically control an orientation of a wing off a sailing vessel, comprising:

a cam comprising a dwell portion and a nose portion that form a cam profile, and a retainer formed longitudinally therethrough for securing a mast of the wing therein;

a tensioner comprising a first portion in contact with the cam profile and exerting a predetermined force perpendicularly against the cam profile;

wherein the dwell portion comprises a constant first radius from a center point of the retainer between a first cam angle and a second cam angle, and the nose portion comprises a symmetric nose profile that causes the cam to produce a counter-torque against the mast when the tensioner is in contact with the nose profile.

2. The mechanism of claim 1, wherein the counter-torque is equal to a torque generated by the mast as wind acts on the wing.

3. The mechanism of claim 1, wherein the cam produces no counter-torque against the mast when the tensioner is in contact with the dwell portion.

4. The mechanism of claim 1, wherein the counter-torque generated by the cam is constant as the cam is rotated by the mast.

5. The mechanism of claim 1, wherein the counter-torque is zero as the cam is rotated by the mast along the dwell portion, and the cam generates a constant counter-torque as the cam is rotated against the tensioner along the nose profile.

6. The mechanism of claim 1, wherein a dwell angle associated with the dwell portion is equal to a no-go sailing angle of the sailing vessel.

7. A sailing vessel comprising a sail coupled to a mast, the sailing vessel comprising:

a deck;

a mast mount formed into the deck;

a cam comprising a mast hole co-located with the mast mount;

the mast, having a first end portion rotatably secured within the mast mount and fixedly secured to the cam;

a tensioner comprising a first portion in contact with a cam profile of the cam and exerting a predetermined force perpendicularly against the cam profile;

wherein the cam profile comprises a dwell portion and a nose portion, the nose portion configured to generate a counter-torque to counteract a mast torque produced by the mast.

8. The sailing vessel of claim 7, wherein the counter-torque is equal in magnitude to the mast torque.

9. The sailing vessel of claim 7, wherein the cam produces no counter-torque against the mast when the tensioner is in contact with the dwell portion.

10. The sailing vessel of claim 7, wherein the counter-torque remains constant as the mast rotates the nose portion of the cam against the tensioner.

11. The sailing vessel of claim 7, wherein the counter-torque is zero as the cam is rotated by the mast along the dwell portion, and the cam generates a constant counter-torque as the cam is rotated against the tensioner along the nose profile.

12. The sailing vessel of claim 7, wherein a dwell angle associated with the dwell portion is equals a no-go sailing angle of the sailing vessel.

13. A mechanism to automatically control an orientation of a rotatable mast of a sailing vessel, the mast producing a mast torque as an apparent wind acts on a sail coupled to the mast, the mechanism comprising:

means for producing a counter-torque against the mast torque when the mast is rotated by the apparent wind to a first orientation, comprising a retainer formed longitudinally therethrough for securing an end portion of the mast therein, a cam, comprising a dwell portion comprising a constant first radius from a center point of the retainer between a first cam angle and a second cam angle, and a nose portion comprising a symmetric nose profile that causes the cam to produce the counter-torque against the mast when the tensioner is in contact with the nose profile;

means for exerting a predetermined force perpendicularly against the means for producing the counter-torque;

wherein the counter-torque is equal in magnitude to the mast torque, causing the mast orientation to remain at a predetermined orientation with respect to the apparent wind.

14. The mechanism of claim 13, wherein a magnitude of the counter-torque is equal to a magnitude of the mast torque.

15. The mechanism of claim 13, wherein the means for producing a counter-torque produces no counter-torque when the mast is rotated by the apparent wind into a second orientation.

16. The mechanism of claim 13, wherein a magnitude of the counter-torque is constant as the means for producing a counter-torque is rotated by the mast against the means for exerting a predetermined force between a first orientation angle and a second orientation angle.

17. The mechanism of claim 13, wherein the first orientation comprises an angle with respect to the apparent wind that is outside of a no-go sailing angle of the sailing vessel.

* * * * *